US009807520B2

(12) United States Patent
Inagaki

(10) Patent No.: US 9,807,520 B2
(45) Date of Patent: Oct. 31, 2017

(54) ACOUSTIC DEVICE AND METHOD OF USING THE SAME

(71) Applicant: KYOCERA CORPORATION, Kyoto (JP)

(72) Inventor: Tomohiro Inagaki, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 14/893,556

(22) PCT Filed: May 21, 2014

(86) PCT No.: PCT/JP2014/064042
§ 371 (c)(1),
(2) Date: Nov. 24, 2015

(87) PCT Pub. No.: WO2014/192778
PCT Pub. Date: Dec. 4, 2014

(65) Prior Publication Data

US 2016/0134977 A1 May 12, 2016

(30) Foreign Application Priority Data

May 29, 2013 (JP) ..... 2013-112612

(51) Int. Cl.
*H04R 29/00* (2006.01)
*H04R 25/00* (2006.01)
*H04R 17/00* (2006.01)

(52) U.S. Cl.
CPC ..... *H04R 25/30* (2013.01); *H04R 17/00* (2013.01); *H04R 25/606* (2013.01); *H04R 2460/13* (2013.01); *H04R 2499/11* (2013.01)

(58) Field of Classification Search
CPC ..... H04R 25/30; H04R 25/50; H04R 17/00; H04R 25/606; H04R 2460/11; H04R 2460/13; H04R 2460/05; H04R 2460/09
(Continued)

(56) References Cited

U.S. PATENT DOCUMENTS

2014/0283614 A1 9/2014 Inagaki et al.

FOREIGN PATENT DOCUMENTS

JP 2002-315098 A 10/2002
JP 2005-311415 A 11/2005
(Continued)

OTHER PUBLICATIONS

International Search Report issued in PCT/JP2014/064042, mailed Jun. 24, 2014.
(Continued)

*Primary Examiner* — Paul S Kim
*Assistant Examiner* — Sabrina Diaz
(74) *Attorney, Agent, or Firm* — Studebaker & Brackett PC

(57) ABSTRACT

The disclosed acoustic device and method of using the same allow perception of a bright, clear sound. In an acoustic device (1) for transmitting sound to a user through vibration conduction by contacting a vibrating body (10*a*) to a human auricle, when a measurement system (10), provided with an ear model (50) including an artificial auricle (51) and an artificial external ear canal (53) and with a microphone (62) that measures air-conducted sound in the artificial external ear canal (53), measures the air-conducted sound upon the acoustic device (1) outputting a fundamental frequency at a predetermined frequency in an audible frequency band while placed in contact with the ear model (50), three or more harmonics at or above the sixth harmonic and having a volume exceeding a volume 45 dB below the volume of the fundamental frequency are measured.

21 Claims, 31 Drawing Sheets
(3 of 31 Drawing Sheet(s) Filed in Color)

(58) Field of Classification Search
USPC ..... 381/58, 60, 63; 73/585, 649
See application file for complete search history.

(56) References Cited

FOREIGN PATENT DOCUMENTS

| | | | |
|---|---|---|---|
| JP | 2005-348193 | A | 12/2005 |
| JP | 2007-019898 | A | 1/2007 |
| JP | 2007-103989 | A | 4/2007 |
| JP | 2007-221532 | A | 8/2007 |
| JP | 2009-036995 | A | 2/2009 |
| JP | 2013-078116 | A | 4/2013 |
| WO | 2013/172039 | A1 | 11/2013 |

OTHER PUBLICATIONS

Written Opinion issued in PCT/JP2014/064042, mailed Jun. 24, 2014.

PRIOR ART

PRIOR ART

FIG. 23

| Direct value | Ffeq (Hz) | 15×18 | 14×18 | 13×18 | 12×18 | 11×18 | 10×18 | 9×18 | 8×18 |
|---|---|---|---|---|---|---|---|---|---|
| 500 | Fundamental frequency | 80 | 79.8 | 77.3 | 82.4 | 83.0 | 86.0 | 86.5 | 79.9 |
| 1000 | 2nd | 43 | 37.1 | 35.6 | 37.6 | 43.0 | 50.3 | 57.1 | 41.3 |
| 1500 | 3rd | 39 | 41.1 | 49.3 | 45.4 | 44.6 | 57.9 | 43.1 | 45.5 |
| 2000 | 4th | 32 | 31.9 | 32.6 | 30.0 | 31.2 | 31.2 | 31.1 | 29.4 |
| 2500 | 5th | 38 | 44.4 | 35.7 | 39.5 | 32.7 | 32.9 | 37.4 | 34.9 |
| 3000 | 6th | 35 | 38.9 | 37.3 | 37.3 | 41.5 | 43.1 | 40.2 | 35.7 |
| 3500 | 7th | 53 | 42.3 | 41.0 | 37.8 | 51.8 | 32.0 | 39.8 | 39.5 |
| 4000 | 8th | 37 | 32.6 | 32.1 | 33.2 | 37.2 | 32.8 | 32.0 | 28.0 |
| 4500 | 9th | 49 | 44.6 | 45.1 | 45.8 | 48.0 | 52.0 | 48.4 | 45.1 |
| 5000 | 10th | 37 | 33.5 | 35.8 | 36.5 | 34.8 | 37.6 | 34.9 | 30.5 |
| 5500 | 11th | 44 | 42.0 | 37.0 | 42.3 | 44.3 | 43.0 | 39.7 | 39.2 |
| 6000 | 12th | 46 | 43.0 | 39.7 | 39.7 | 40.8 | 42.6 | 42.5 | 35.2 |
| 6500 | 13th | 45 | 38.8 | 39.7 | 36.2 | 42.9 | 40.1 | 38.4 | 34.7 |
| 7000 | 14th | 45 | 41.4 | 38.3 | 36.1 | 39.5 | 38.6 | 37.4 | 36.1 |
| 7500 | 15th | 44 | 42.6 | 40.0 | 38.4 | 36.4 | 43.0 | 36.5 | 32.9 |
| 8000 | 16th | 26 | 31.6 | 25.3 | 24.5 | 26.6 | 31.6 | 24.6 | 24.4 |

ACOUSTIC DEVICE AND METHOD OF USING THE SAME

CROSS-REFERENCE TO RELATED APPLICATION

This application claims priority to and the benefit of Japanese Patent Application No. 2013-112612 filed May 29, 2013, the entire contents of which are incorporated herein by reference.

TECHNICAL FIELD

This disclosure relates to an acoustic device, such as a hearing aid, and to a method of using the same.

BACKGROUND

One type of acoustic device uses a bone conduction technique that causes a user to hear sound by contacting a vibrating body to the user's auricle, such as the tragus or the like of the ear (for example, see JP 2005-348193 A (PTL 1)). An acoustic device using a bone conduction technique transmits vibration directly to the auditory nerve and thus places little strain on the eardrum. Such an acoustic device is therefore better than an earphone, headphone, or other acoustic device that does not use a bone conduction technique.

CITATION LIST

Patent Literature

PTL 1: JP 2005-348193 A

SUMMARY

Technical Problem

An acoustic device using a bone conduction technique, however, suffers from the problem of sound being occluded, making it difficult to output high-frequency sound. The reason is that few harmonics are included in the sound output by such an acoustic device. A harmonic is sound at a frequency that is an integer multiple (two or greater) of the frequency of the output sound (fundamental frequency). In general, when few harmonics are included in the sound output by an acoustic device, the resulting sound is not well-defined and seems obscure and occluded. On the other hand, when many harmonics are included in the sound output by an acoustic device, the result is a bright, clear, sharply-defined sound. When the sound pressure of harmonics at even higher frequencies is high, the result is a sharp, hard sound, whereas when the sound pressure of low-frequency harmonics is high, the result is a soft yet strong sound.

As an acoustic device that transmits sound to a user by vibration conduction, such as bone conduction, it would therefore be helpful to provide an acoustic device, and a method of using the same, that generates harmonics and allows the user to perceive a bright, clear sound.

Solution to Problem

In order to solve the above problem, the disclosed acoustic device is for transmitting sound to a user through vibration conduction by contacting a vibrating body to a human auricle, such that when a measurement system, provided with an ear model including an artificial auricle and an artificial external ear canal and with a microphone that measures air-conducted sound in the artificial external ear canal, measures the air-conducted sound upon the acoustic device outputting a fundamental frequency at a predetermined frequency in an audible frequency band while placed in contact with the ear model, three or more harmonics at or above a sixth harmonic and having a volume exceeding a volume 45 dB below a volume of the fundamental frequency are measured.

Advantageous Effect

The acoustic device and method of using the same of this disclosure generate harmonics and allow perception of a bright, clear sound.

BRIEF DESCRIPTION OF THE DRAWINGS

The patent or application file contains at least one drawing executed in color. Copies of this patent or patent application publication with color drawing(s) will be provided by the Office upon request and payment of the necessary fee. In the accompanying drawings:

FIG. 23 illustrates data on measurement results, using the measurement system according to Embodiment 1, for air-conducted sound and human body vibration sound in the case of changing the size of the panel in the acoustic device;

DETAILED DESCRIPTION

The following describes embodiments with reference to the drawings.

Embodiment 1

When the disclosed acoustic device is measured with the measurement system described in detail below, predetermined harmonics are measured. First, the disclosed measurement system is described.

Structure and Operations of Measurement System

Figure 1:
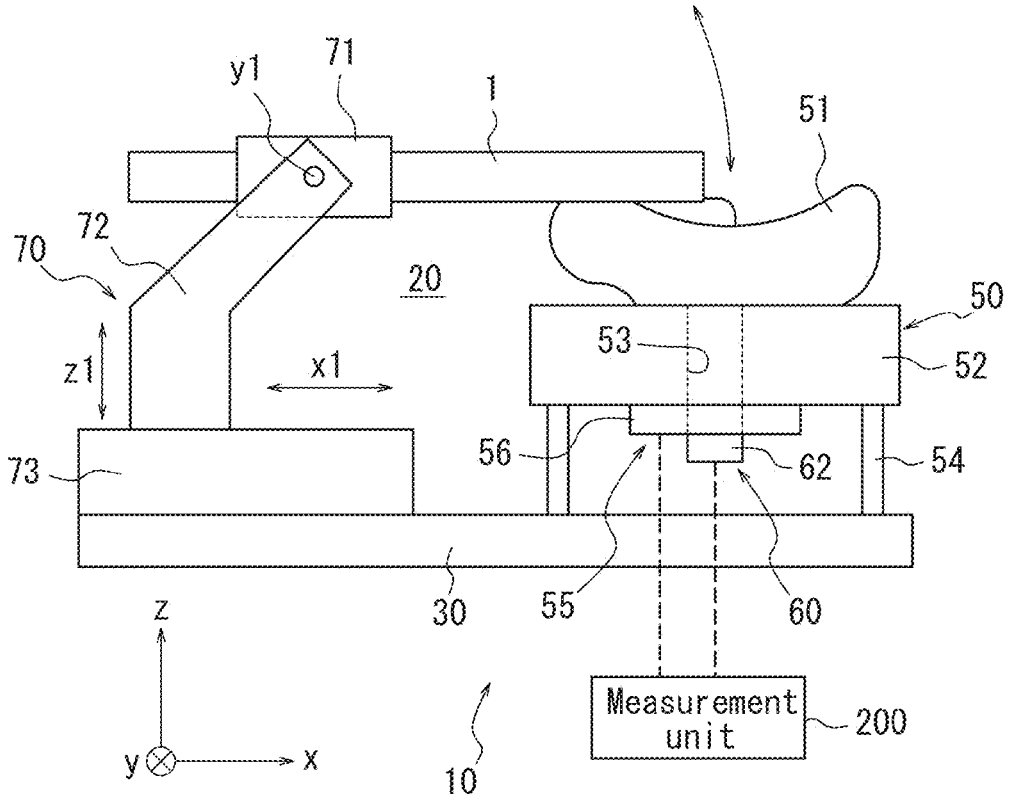
FIG. 1 schematically illustrates the structure of a measurement system according to Embodiment 1.

FIG. 1 schematically illustrates the structure of a measurement system 10 according to Embodiment 1. The measurement system 10 of this embodiment includes an acoustic device mount 20 and a measurement unit 200. The acoustic device mount 20 is provided with an ear model 50 supported by a base 30 and with a holder 70 that supports an acoustic device 1 targeted for measurement. The acoustic device 1 in FIG. 1 is assumed to be a hearing aid, or to be a mobile phone, such as a smartphone, that includes a rectangular panel larger than a human ear on a surface of a rectangular housing and that vibrates with the panel as a vibrating body. First, the structure of the acoustic device mount 20 is described.

The ear model 50 is modeled after a human ear and includes an artificial auricle 51 and artificial external ear canal unit 52 joined to the artificial auricle 51. The artificial external ear canal unit 52 is large enough to cover the artificial auricle 51 and has an artificial external ear canal 53 formed in the central region thereof. The ear model 50 is supported by the base 30 via a support member 54 at the periphery of the artificial external ear canal unit 52.

The ear model 50 is made from similar material to the material of an average artificial auricle used in, for example, a manikin such as a Head And Torso Simulator (HATS), Knowles Electronic Manikin for Acoustic Research (KEMAR), or the like, such as material conforming to IEC 60318-7. This material may, for example, be formed with a material such as rubber having a hardness of 35 to 55. The hardness of rubber may, for example, be measured in conformity with International Rubber Hardness Degrees (IRHD/M) conforming to JIS K 6253, ISO 48, or the like. As a hardness measurement system, a fully automatic IRHD/M micro-size international rubber hardness gauge GS680 by Teclock Corporation may suitably be used. Note that taking the variation in ear hardness due to age into account, as a rule of thumb, approximately two or three types of the ear model 50 with a different hardness are preferably prepared and used interchangeably.

The thickness of the artificial external ear canal unit 52, i.e. the length of the artificial external ear canal 53, corresponds to the length up to the human eardrum (cochlea) and for example is suitably set in a range of 20 mm to 40 mm. In this embodiment, the length of the artificial external ear canal 53 is approximately 30 mm.

In the ear model 50, a vibration gauge 55 is disposed on the end face of the artificial external ear canal unit 52 on the opposite side from the artificial auricle 51, at a position in the peripheral portion of the opening of the artificial external ear canal 53. The vibration gauge 55 detects the amount of vibration transmitted through the artificial external ear canal unit 52 when the vibrating body of the acoustic device 1 is placed against the ear model 50. In other words, the vibration gauge 55 detects the amount of vibration corresponding to the human body vibration sound component that is heard without passing through the eardrum when the vibrating body of the acoustic device 1 is pressed against a human ear and vibration of the vibrating body of the acoustic device 1 directly vibrates the inner ear. Human body vibration sound as referred to here is sound that is transmitted to the user's auditory nerve through a portion of the user's body (such as the cartilage of the outer ear) that is contacting a vibrating object. The vibration gauge 55 is, for example, configured using a vibration detection element 56 that has flat output characteristics in the measurement frequency range of the acoustic device 1 (for example, from 0.1 kHz to 30 kHz), is lightweight, and can accurately measure even slight vibrations. An example of this vibration detection element 56 is a piezoelectric acceleration pickup or other such vibration pickup, such as the vibration pickup PV-08A produced by Rion Corporation or the like.

Figure 2A:
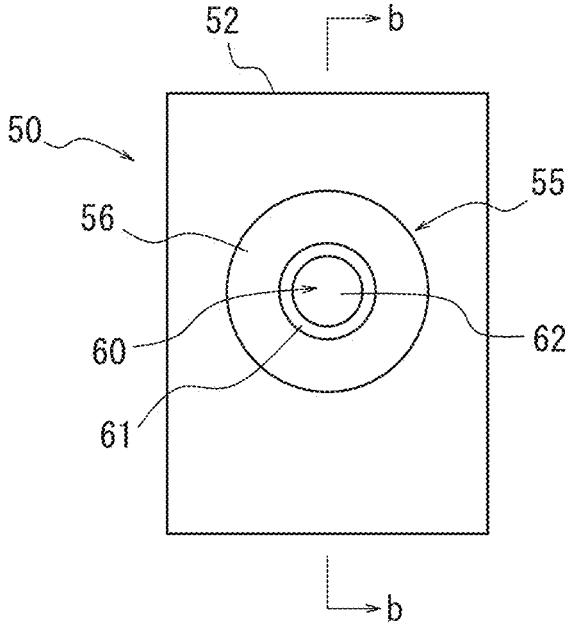
FIGS. 2A and 2B are detailed diagrams of the ear model in FIG. 1.

FIG. 2A is a plan view of the ear model 50 from the base 30 side.

While FIG. 2A illustrates an example of providing a ring-shaped vibration detection element 56 that surrounds the peripheral portion of the opening of the artificial external ear canal 53, a plurality of vibration detection elements 56 may be provided instead of only one. In the case of providing a plurality of vibration detection elements 56, the vibration detection elements may be disposed at appropriate intervals at the periphery of the artificial external ear canal 53, or two arc-shaped vibration detection elements may be disposed as an arc surrounding the periphery of the opening in the artificial external ear canal 53. In FIG. 2A, the artificial external ear canal unit 52 is rectangular, yet the artificial external ear canal unit 52 may be any shape.

Furthermore, a sound pressure measurement unit 60 is disposed in the ear model 50. The sound pressure measurement unit 60 measures the sound pressure of sound propagating through the artificial external ear canal 53. In other words, the sound pressure measurement unit 60 measures the sound pressure produced when the vibrating body of the acoustic device 1 is pressed against a human ear. This sound pressure includes sound pressure corresponding to air-conducted sound that is heard directly through the eardrum by air vibrating due to vibration of the vibrating body of the acoustic device 1 and sound pressure corresponding to air-conducted sound representing sound, heard through the eardrum, that is produced in the ear itself by the inside of the external ear canal vibrating due to vibration of the vibrating body of the acoustic device 1. Air-conducted sound as referred to here is sound transmitted to the user's auditory nerve by air vibrations, caused by a vibrating object, that are transmitted through the external ear canal to the eardrum and cause the eardrum to vibrate.

Figure 2B:
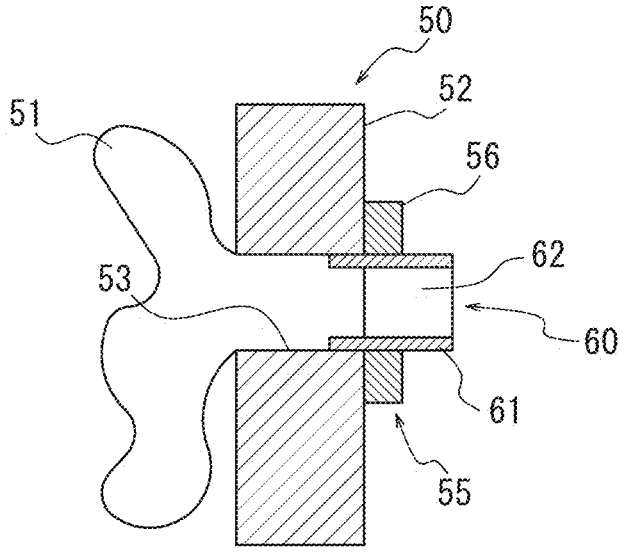

As illustrated by the cross-sectional view in FIG. 2B along the b-b line in FIG. 2A, the sound pressure measurement unit 60 includes a microphone 62 held by a tube member 61 that extends from the outer wall (peripheral wall of the hole) of the artificial external ear canal 53 through the opening of the ring-shaped vibration detection element 56. The microphone 62 is, for example, configured using a measurement capacitor microphone that has a low self-noise level and that has flat output characteristics in the measurement frequency range of the acoustic device 1. The capacitor microphone UC-53A produced by Rion Corporation may, for example, be used as the microphone 62. The microphone 62 is disposed so that the sound pressure detection face nearly matches the end face of the artificial external ear canal unit 52. The microphone 62 may, for example, be supported by the artificial external ear canal unit 52 or the base 30 and disposed in a floating state with respect to the outer wall of the artificial external ear canal 53.

Next, the holder 70 is described. The holder 70 is provided with a support 71 that supports both sides of the acoustic device 1. The support 71 is attached to one end of an arm 72 so as to be rotatable about an axis y1, which is parallel to the y-axis, in a direction to press the acoustic device 1 against the ear model 50. The other end of the arm 72 is joined to a movement adjuster 73 provided on the base 30. The movement adjuster 73 can adjust movement of the arm 72 in a vertical direction x1 of the acoustic device 1 supported by the support 71, the direction x1 being parallel to the x-axis that is orthogonal to the y-axis, and in a direction z1 that presses the acoustic device 1 against the ear model 50, the direction z1 being parallel to the z-axis that is orthogonal to the y-axis and the x-axis.

In this way, in the acoustic device 1 supported by the support 71, the pressing force, against the ear model 50, of the vibrating body is adjusted by rotating the support 71 about the axis y1 or by moving the arm 72 in the z1 direction. In this embodiment, the pressing force is adjusted in a range of 0 N to 10 N. Of course, the support 71 may also be configured to rotate freely about other axes in addition to the y1 axis.

The reason for the range from 0 N to 10 N is to allow measurement over a range that is sufficiently wider than the pressing force that is envisioned when a human presses the acoustic device against an ear, for example to converse. The case of 0 N may, for example, include not only the case of contacting without pressing against the ear model 50, but also the case of holding the acoustic device 1 at a distance from the ear model 50 in increments of 1 cm and measuring at each distance. This approach also allows measurement with the microphone 62 of the degree of damping of air-conducted sound due to distance, thus making the measurement system more convenient.

By adjusting the arm 72 in the x1 direction, the contact position of the acoustic device 1 with respect to the ear model 50 can be adjusted so that, for example, the vibrating body covers nearly the entire ear model 50, or so that the vibrating body covers a portion of the ear model 50, as illustrated in FIG. 1. A configuration may also be adopted to allow adjustment of the acoustic device 1 to a variety of contact positions with respect to the ear model 50 by making movement of the arm 72 adjustable in a direction parallel to the y-axis, or by making the arm 72 rotatable about an axis parallel to the x-axis or the z-axis. The vibrating body is not limited to an object like a panel that widely covers the ear, and for example an acoustic device having a protrusion or corner that transmits vibration to only a portion of the ear model 50, such as the tragus, may be targeted for measurement.

Figure 3:
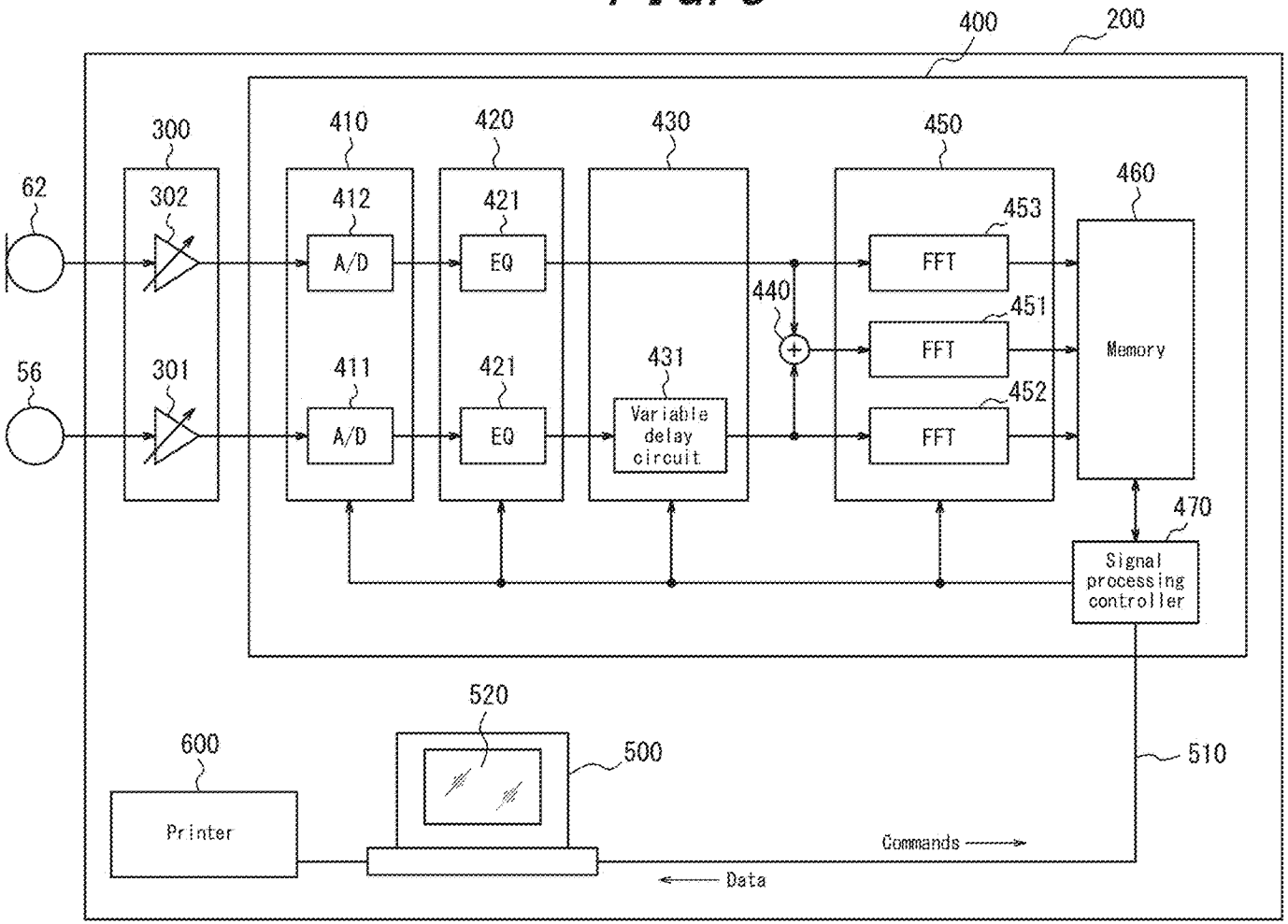
FIG. 3 is a functional block diagram illustrating the structure of the measurement unit in FIG. 1.

Next, the structure of the measurement unit 200 in FIG. 1 is described. FIG. 3 is a functional block diagram illustrating the structure of the measurement unit 200. In this embodiment, the measurement unit 200 measures the amount of vibration and the sound pressure transmitted through the ear model 50 by vibration of the acoustic device 1 targeted for measurement, i.e. sensory sound pressure that combines human body vibration sound and air-conducted sound, and includes a sensitivity adjuster 300, signal processor 400, personal computer (PC) 500, and printer 600.

Output of the vibration detection element 56 and the microphone 62 is provided to the sensitivity adjuster 300. The sensitivity adjuster 300 includes a variable gain amplifier circuit 301 that adjusts the amplitude of the output of the vibration detection element 56 and a variable gain amplifier circuit 302 that adjusts the amplitude of the output of the microphone 62. The amplitudes of analog input signals, corresponding to the respective circuits, are independently adjusted to required amplitudes either manually or automatically. Error in the sensitivity of the vibration detection element 56 and the sensitivity of the microphone 62 is thus corrected. Note that the variable gain amplifier circuits 301 and 302 are configured to allow adjustment of the amplitude of the input signals over a range of, for example, ±20 dB.

Output of the sensitivity adjuster 300 is input into the signal processor 400. The signal processor 400 includes an A/D converter 410, frequency characteristic adjuster 420, phase adjuster 430, output combiner 440, frequency analyzer 450, memory 460, and signal processing controller 470. The A/D converter 410 includes an A/D conversion circuit (A/D) 411 that converts the output of the variable gain amplifier circuit 301 into a digital signal and an A/D conversion circuit (A/D) 412 that converts the output of the variable gain amplifier circuit 302 into a digital signal. The analog input signal corresponding to each circuit is thus converted into a digital signal. The A/D conversion circuits 411 and 412 are, for example, 16 bits or more and can support 96 dB or more by dynamic range conversion. The A/D conversion circuits 411 and 412 may also be configured so that the dynamic range is changeable.

Output of the A/D converter 410 is provided to the frequency characteristic adjuster 420. The frequency characteristic adjuster 420 includes an equalizer (EQ) 421 that adjusts the frequency characteristic of the detection signal from the vibration detection element 56, i.e. the output of the A/D conversion circuit 411, and an equalizer (EQ) 422 that adjusts the frequency characteristic of the detection signal from the microphone 62, i.e. the output of the A/D conversion circuit 412. The frequency characteristics of the respective input signals are independently adjusted to frequency characteristics near the auditory sensation of the human body either manually or automatically. The equalizers 421 and 422 may, for example, be configured with a graphical equalizer having a plurality of bands, a low pass filter, a high pass filter, or the like. The order in which the equalizers (EQ) and the A/D conversion circuits are disposed may be reversed.

Output of the frequency characteristic adjuster 420 is provided to the phase adjuster 430. The phase adjuster 430 includes a variable delay circuit 431 that adjusts the phase of the detection signal from the vibration detection element 56, i.e. the output of the equalizer 421. In other words, since the speed of sound transmitted through the material of the ear model 50 is not exactly the same as the speed of sound transmitted through human muscle or bone, it is assumed that the phase relationship between the output of the vibration detection element 56 and the output of the microphone 62 will be shifted from that of a human ear, the shift being greater at high frequencies.

Figure 4A:
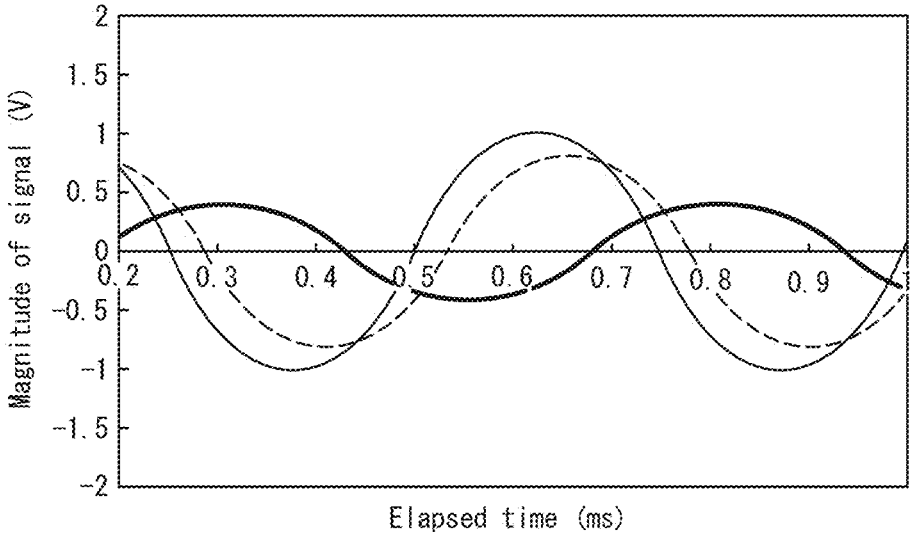
FIGS. 4A and 4B illustrate the phase relationship between output of the vibration detection element and output of the microphone in FIG. 3.
Figure 4B:
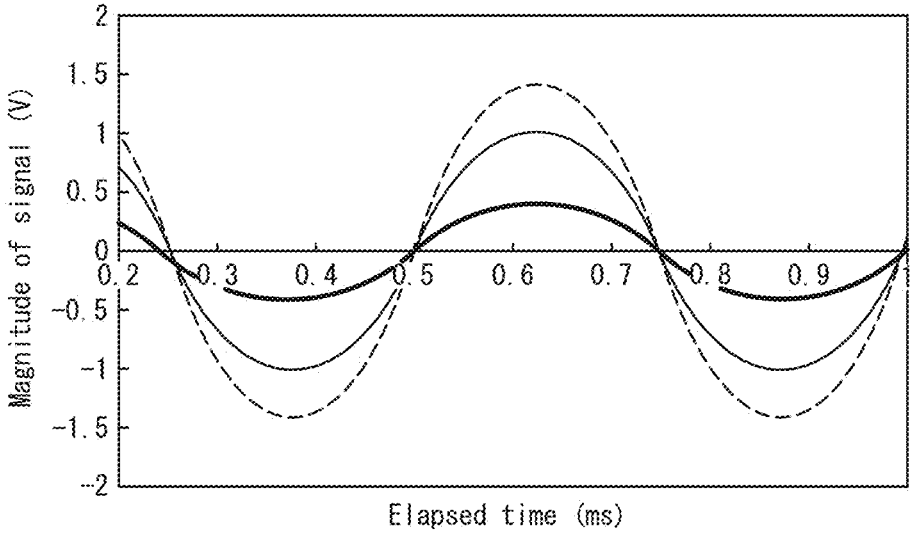

If the phase relationship between the output of the vibration detection element 56 and the output of the microphone 62 thus shifts greatly, then upon combining the two outputs with the below-described output combiner 440, amplitude peaks and dips may appear at different values than in actuality, and the combined output may be amplified or diminished. For example, if the transmission speed of sound detected by the microphone 62 is 0.2 ms slower than the transmission speed of vibration detected by the vibration detection element 56, then the combined output of both as sinusoidal vibration at 2 kHz is as illustrated in FIG. 4A. By contrast, the combined output when there is no misalignment in the transmission speeds is as illustrated in FIG. 4B, and amplitude peaks and dips appear at unnatural times. In FIGS. 4A and 4B, the bold line indicates a vibration waveform detected by the vibration detection element 56, the thin line indicates a sound pressure waveform detected by the microphone 62, and the dashed line indicates the waveform of the combined output.

Therefore, in this embodiment, in accordance with the measurement frequency range of the acoustic device 1 targeted for measurement, the phase of the detection signal from the vibration detection element 56, which is the output of the equalizer 421, is adjusted over a predetermined range by the variable delay circuit 431. For example, in the case of the measurement frequency range of the acoustic device 1 being from 100 Hz to 10 kHz, the phase of the detection signal from the vibration detection element 56 is adjusted by the variable delay circuit 431 over a range of approximately ±10 ms (corresponding to ±100 Hz) at least in increments smaller than 0.1 ms (corresponding to 10 kHz). In the case of a human ear as well, phase misalignment occurs between human body vibration sound and air-conducted sound. Therefore, phase adjustment by the variable delay circuit 431 does not refer to matching the phase of the detection signals from the vibration detection element 56 and the microphone 62, but rather to matching the phase of these detection signals to the actual auditory sensation by the ear.

Output of the phase adjuster 430 is provided to the output combiner 440. The output combiner 440 combines the detection signal from the vibration detection element 56, after phase adjustment by the variable delay circuit 431, with the detection signal, from the microphone 62, that has passed through the phase adjuster 430. This enables approximation of the human body in obtaining sensory sound pressure that combines the amount of vibration and the sound pressure, i.e. the human body vibration sound and the air-conducted sound, transmitted by vibration of the acoustic device 1 targeted for measurement.

The combined output of the output combiner 440 is input into the frequency analyzer 450. The frequency analyzer 450 includes a Fast Fourier Transform (FFT) 451 that performs frequency analysis on the combined output of the output combiner 440. In this way, power spectrum data corresponding to the sensory sound pressure (air+vib), in which the human body vibration sound (vib) and the air-conducted sound (air) are combined, are obtained from the FFT 451.

Furthermore, in this embodiment, the frequency analyzer 450 is provided with FFTs 452 and 453 that perform frequency analysis on the signals before combination by the output combiner 440, i.e. on the detection signal, from the vibration detection element 56, that has passed through the phase adjuster 430 and the detection signal from the microphone 62. In this way, power spectrum data corresponding to the human body vibration sound (vib) are obtained from the FFT 452, and power spectrum data corresponding to the air-conducted sound (air) are obtained from the FFT 453.

In the FFTs 451 to 453, analysis points are set for the frequency component (power spectrum) in correspondence with the measurement frequency range of the acoustic device 1. For example, when the measurement frequency range of the acoustic device 1 is 100 Hz to 10 kHz, analysis points are set so as to analyze the frequency component at each point when dividing the interval in a logarithmic graph of the measurement frequency range into 100 to 200 equal portions.

The output of the FFTs 451 to 453 is stored in the memory 460. The memory 460 has the capacity of at least a double buffer that can store a plurality of analysis data sets (power spectrum data) for each of the FFTs 451 to 453. The memory 460 is configured to always allow transmission of the latest data upon a data transmission request from the below-described PC 500.

The signal processing controller 470 is connected to the PC 500 via a connection cable 510 for an interface such as USB, RS-232C, SCSI, PC card, or the like. Based on commands from the PC 500, the signal processing controller 470 controls operations of each portion of the signal processor 400. The signal processor 400 may be configured as software executed on any suitable processor, such as a central processing unit (CPU), or may be configured with a digital signal processor (DSP).

The PC 500 includes an application to evaluate the acoustic device 1 with the measurement system 10. The evaluation application is copied from a CD-ROM or downloaded over a network or the like. The PC 500 for example displays an application screen on a display 520 based on the evaluation application. Based on information input via the application screen, the PC 500 transmits a command to the signal processor 400. The PC 500 also receives a command acknowledgment and data from the signal processor 400, and based on the received data, executes predetermined processing and displays the measurement results on the application screen. As necessary, the PC 500 also outputs the measurement results to the printer 600 to print the measurement results.

In FIG. 3, the sensitivity adjuster 300 and the signal processor 400 may, for example, be mounted on the base 30 of the acoustic device mount 20, with the PC 500 and printer 600 being disposed separately from the base 30, and the signal processor 400 and PC 500 being connected by a connection cable 510.

Figure 5:
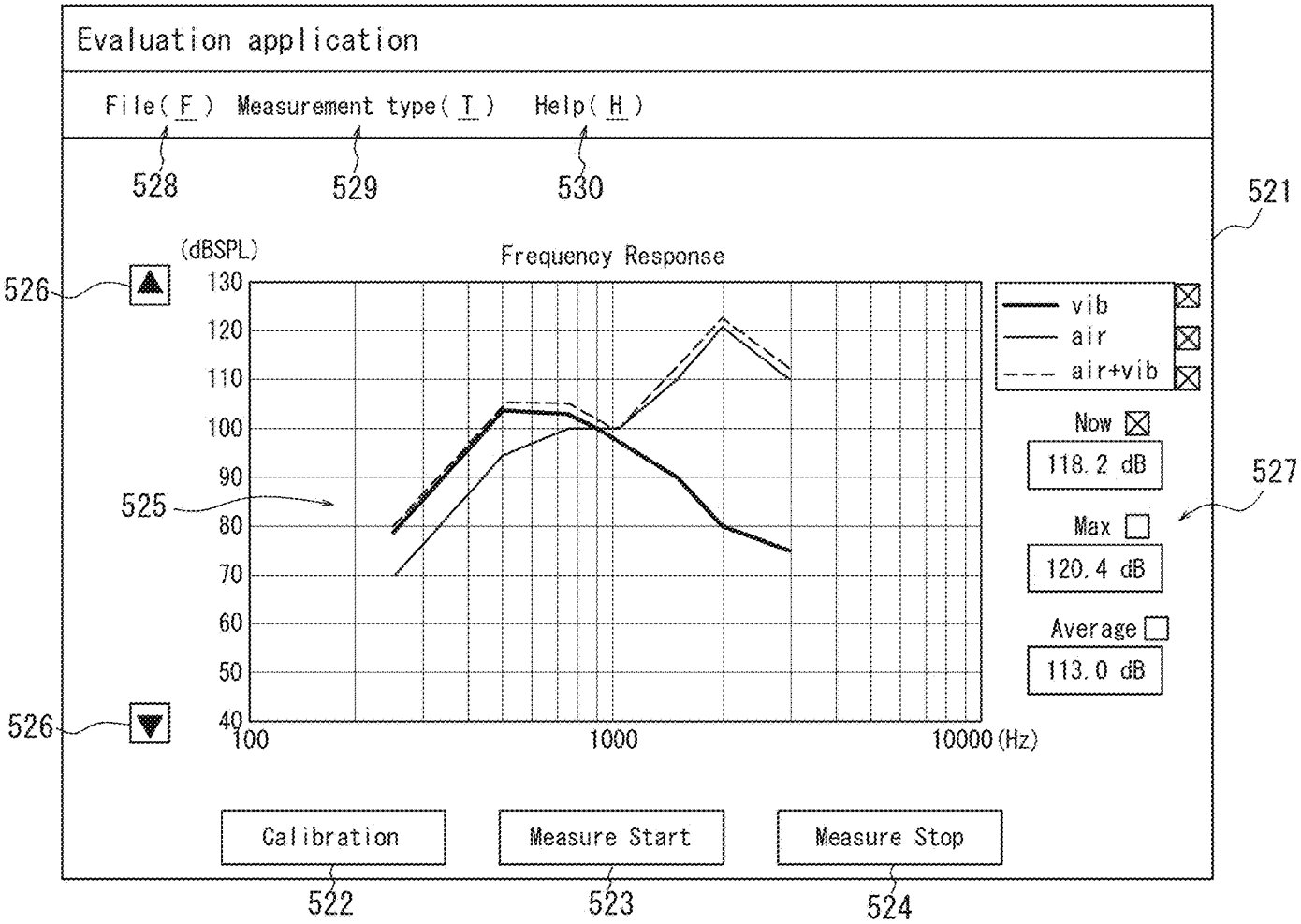
FIG. 5 illustrates an example of an application screen and of measurement results in the measurement system of FIG. 1.
Figure 6:
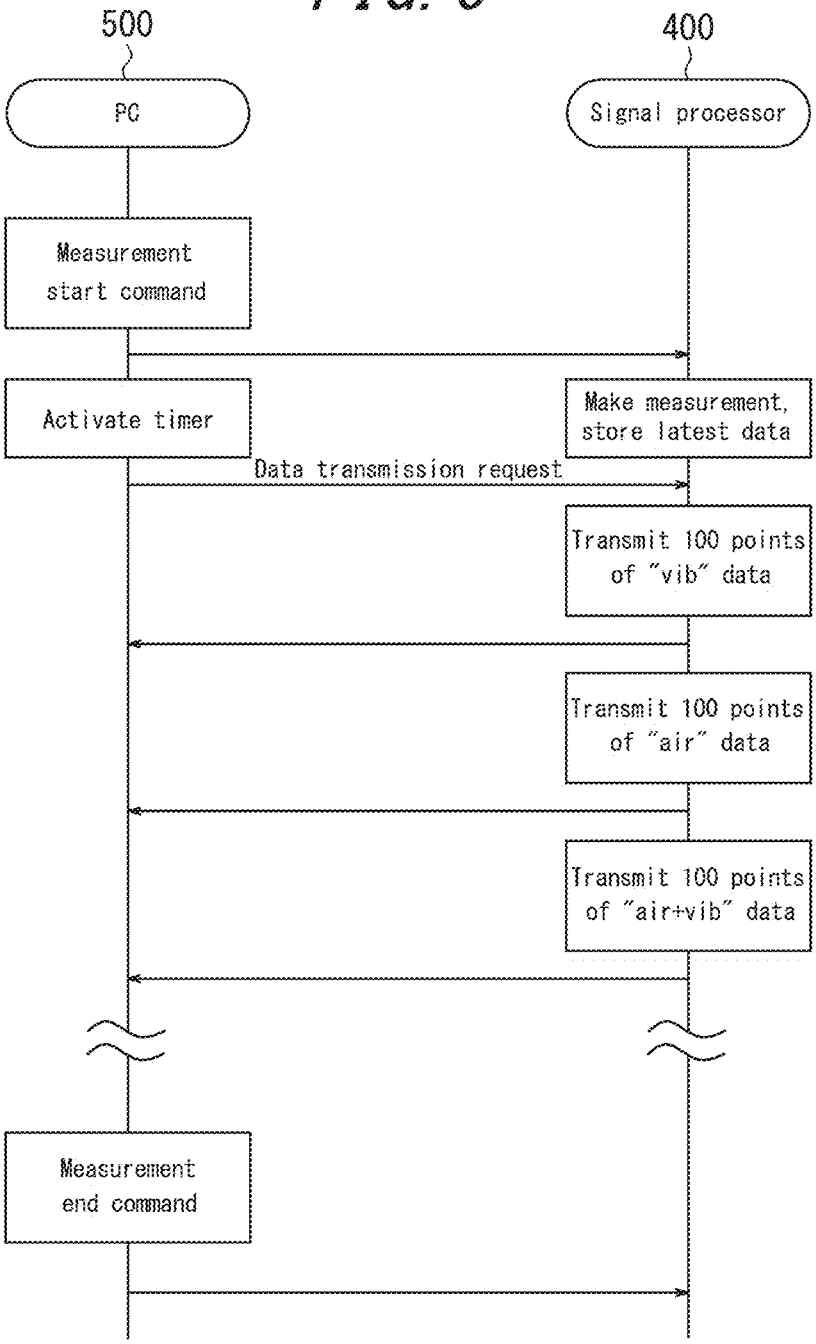
FIG. 6 is a flowchart illustrating an example of measurement operations by the measurement system of FIG. 1.

FIG. 5 illustrates an example of an application screen displayed on the display 520. The application screen 521 in FIG. 5 includes a "Calibration" icon 522, a "Measure Start" icon 523, a "Measure Stop" icon 524, a measurement result display area 525, icons 526 to change the measurement range, a measurement result display selection area 527, a file icon 528, a measurement type icon 529, and a help icon 530. The following describes each function briefly.

The "Calibration" icon 522 corrects error in the sensitivity of the vibration detection element 56 and the microphone 62. In this correction mode, a reference device is set in the holder 70 and brought into contact with the ear model 50 at a reference position. When causing the reference device to vibrate in a predetermined vibration mode (for example, a pure tone or a multi-sine), the sensitivity of the vibration detection element 56 and of the microphone 62 is adjusted by the variable gain amplifier circuits 301 and 302 so that the power spectrum data of the detection signal from the vibration detection element 56 and the power spectrum data of the detection signal from the microphone 62 are within their respective normal error ranges.

The "Measure Start" icon 523 transmits a measurement start command to the signal processor 400 and continues to receive data until the end of measurement. The "Measure Stop" icon 524 transmits a measurement stop command to the signal processor 400 and ends data reception. Based on the received data, measurement results corresponding to the measurement mode selected with the measurement type icon 529 are displayed in the measurement result display area 525. FIG. 5 illustrates an example in which measurement results for the power spectra of vib (human body vibration sound), air (air-conducted sound), and air+vib (sensory sound pressure) in the power spectrum measurement mode are displayed in the measurement result display area 525. The icons 526 to change the measurement range shift the measurement range width of the power spectrum displayed in the measurement result display area 525 by 10 dB increments and transmit a change measurement range command to the signal processor 400. As a result, the signal processor 400 changes the range of A/D conversion by the A/D conversion circuits 411 and 412 in response to the change measurement range command.

The measurement result display selection area 527 displays types of power spectra that can be displayed in the measurement result display area 525 and a selection box for each type, along with a display area and a selection box for each of the current value of the power spectrum (Now), the maximum value during measurement (Max), and the average value during measurement (Average). The power spectrum or high-frequency distortion rate are also displayed in the corresponding areas for the information selected with the selection boxes. The file icon 528 is, for example, for printing the application screen being displayed or for outputting the measurement results in a format such as CSV or EXCEL. The measurement type icon 529 switches between measurement modes, such as power spectrum measurement mode, high-frequency distortion rate measurement mode, and the like. The high-frequency distortion rate displayed in the measurement result display selection area 527 can be calculated in high-frequency distortion rate mode by the PC 500 based on measurement data from the signal processor 400. The help icon 530 displays help on how to use the measurement system 10.

The measurement system 10 of this embodiment evaluates the acoustic device 1 targeted for measurement by analyzing frequency components in the combined output of the vibration detection element 56 and the microphone 62 while using a piezoelectric element, for example, to cause the vibrating body of the acoustic device 1 to vibrate. The piezoelectric element with which the vibrating body is configured may have a predetermined measurement frequency range of, for example, 100 Hz to 10 kHz as mentioned above and may be driven with a multi-drive signal wave that combines drive signals for every 100 Hz.

Figure 7:
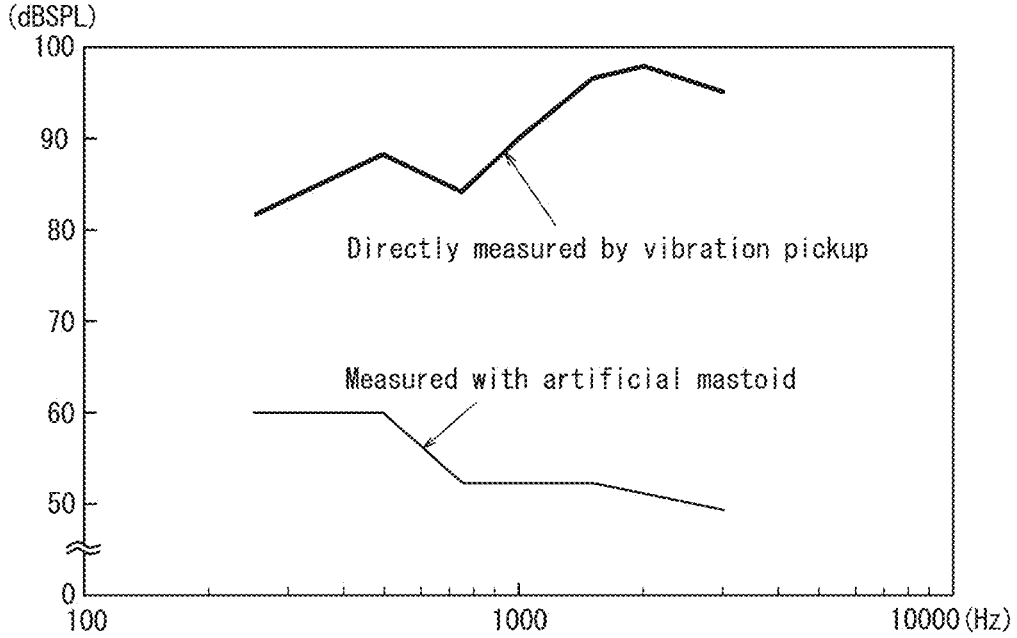
FIG. 7 illustrates the measurement results for the amount of vibration with a known measurement method for the acoustic device from which the measurement results in FIG. 5 were obtained.

With reference to the flowchart in FIG. 7, the following describes an example of operations to measure the acoustic device 1 with the measurement system 10 according to this embodiment. Here, it is assumed that 100 points each of "air+vib" data, "vib" data, and "air" data are obtained with the FFTs 451 to 453 of the frequency analyzer 450.

First, upon the "Measure Start" icon 523 on the application screen 521 in FIG. 5 being pressed, the PC 500 transmits a measurement start command to the signal processor 400. Upon receiving the measurement start command, the signal processor 400 begins to measure the acoustic device 1. As a result, the signal processor 400 adjusts sensitivity of the output of the vibration detection element 56 and the microphone 62 with the sensitivity adjuster 300, then converts the results to digital signals with the A/D converter 410, adjusts the frequency characteristic with the frequency characteristic adjuster 420, and subsequently adjusts the phase with the phase adjuster 430 and combines the results with the output combiner 440. The signal processor 400 then performs frequency analysis on the combined output of the output combiner 440 with the FFT 451 of the frequency analyzer 450 and stores the power spectrum data for 100 points, i.e. the "air+vib" data, in the memory 460.

Simultaneously, the signal processor 400 performs frequency analysis with the FFT 452 on the detection signal from the vibration detection element 56, the phase of which was adjusted by the variable delay circuit 431 of the phase adjuster 430, and stores the power spectrum data for 100 points, i.e. the "vib" data, in the memory 460. Similarly, the signal processor 400 performs frequency analysis with the FFT 453 on the detection signal, from the microphone 62, that passed through the phase adjuster 430 and stores the power spectrum data for 100 points, i.e. the "air" data, in the memory 460.

The signal processor 400 repeats the FFT processing by the FFTs 451 to 453 at predetermined timings and stores the results in the memory 460. The memory 460 thus stores the data from the FFTs 451 to 453 by consecutively updating the data so as always to retain the latest data.

Subsequently, the PC 500 activates a timer at a predetermined timing and transmits a command for a data transmission request to the signal processor 400. Upon receiving the data transmission request from the PC 500, the signal processor 400 consecutively transmits 100 points each of the latest "vib" data, "air" data, and "air+vib" data stored in the memory 460 to the PC 500.

Until transmitting a measurement stop command to the signal processor 400, the PC 500 continues to transmit a command for the data transmission request to the signal processor 400 at each set time of the timer, thereby acquiring the latest "vib" data, "air" data, and "air+vib" data. Upon each acquisition of data from the signal processor 400, the PC 500 displays the measurement results on the application screen 521 in FIG. 5 based on the acquired data.

Subsequently, upon the "Measure Stop" icon 524 on the application screen 521 in FIG. 5 being pressed, the PC 500 transmits a measurement stop command to the signal processor 400. As a result, the PC 500 and the signal processor 400 stop measurement operations. The above-described results of measuring the acoustic device 1 are output from the printer 600 as necessary during or after the end of measurement of the acoustic device 1.

The measurement results illustrated in FIG. 5 from the measurement system 10 according to this embodiment are explained in comparison with a known measurement method. FIG. 7 illustrates the power spectra for the amount of vibration upon measuring the same acoustic device 1 targeted for measurement as in FIG. 5 with a known measurement method. In FIG. 7, the bold line indicates the power spectrum measured by pressing a vibration pickup against the vibrating body targeted for measurement, and the thin line indicates the power spectrum measured via an artificial mastoid.

As is clear from FIGS. 5 and 7, as compared to a known artificial mastoid method, the power spectrum corresponding to the human body vibration sound component measured based on output of the vibration detection element 56 in this embodiment is larger than the power spectrum with the artificial mastoid method. Furthermore, upon comparison with a direct measurement method using a known vibration pickup, the power spectrum is smaller than with the direct measurement method in a frequency band exceeding a certain value. In other words, the power spectrum corresponding to the human body vibration sound component measured with this embodiment is weighted for the characteristics of vibration transmission in a human ear.

Furthermore, in this embodiment, the microphone 62 measures sound pressure through the ear model 50. Accordingly, the power spectrum corresponding to the air-conducted component measured based on output of the microphone 62 is a combination of the sound pressure corresponding to the air-conducted component that is heard directly through the eardrum by air vibrating due to vibration of the acoustic device 1 and sound pressure corresponding to the air-conducted component representing sound, heard through the eardrum, that is produced in the ear itself by the inside of the external ear canal vibrating due to vibration of the acoustic device 1. In other words, the power spectrum corresponding to the air-conducted component measured with this embodiment is weighted for the characteristics of sound pressure transmission in a human ear.

Moreover, in the measurement system 10 of this embodiment, after the phases of the output corresponding to the human body vibration sound component from the vibration detection element 56 and the output corresponding to the air-conducted component from the microphone 62 are adjusted by the phase adjuster 430, the two outputs are combined by the output combiner 440 and subjected to frequency analysis by the frequency analyzer 450. Accordingly, the sensory sound pressure that combines the amount of vibration and the sound pressure conducted to the human body due to vibration of the acoustic device 1 targeted for measurement can be measured by approximating the human body. This approach enables evaluation of the acoustic device 1 to a high degree of accuracy and increases the reliability of the measurement system 10.

In this embodiment, the output corresponding to the human body vibration sound component from the vibration detection element 56 and the output corresponding to the air-conducted component from the microphone 62 are independently subjected to frequency analysis by the frequency analyzer 450, thereby allowing more detailed evaluation of the acoustic device 1. Furthermore, the sensitivity of the vibration detection element 56 and of the microphone 62 is adjusted by the sensitivity adjuster 300, thereby allowing measurement of sensory sound pressure by age or the like. Hence, the acoustic device 1 can be evaluated in accordance with the function of an individual's ear. Also, since the frequency characteristics of the output corresponding to the human body vibration sound component from the vibration detection element 56 and of the output corresponding to the air-conducted component from the microphone 62 can be adjusted independently with the frequency characteristic adjuster 420, the acoustic device 1 can be evaluated to a high degree of accuracy in accordance with the function of an individual's ear.

Furthermore, the acoustic device 1 targeted for measurement can adjust the pressing force on the ear model 50 and can also adjust the contact position, thus allowing a variety of forms of evaluating the acoustic device 1.

Structure of Acoustic Device

Figure 8:
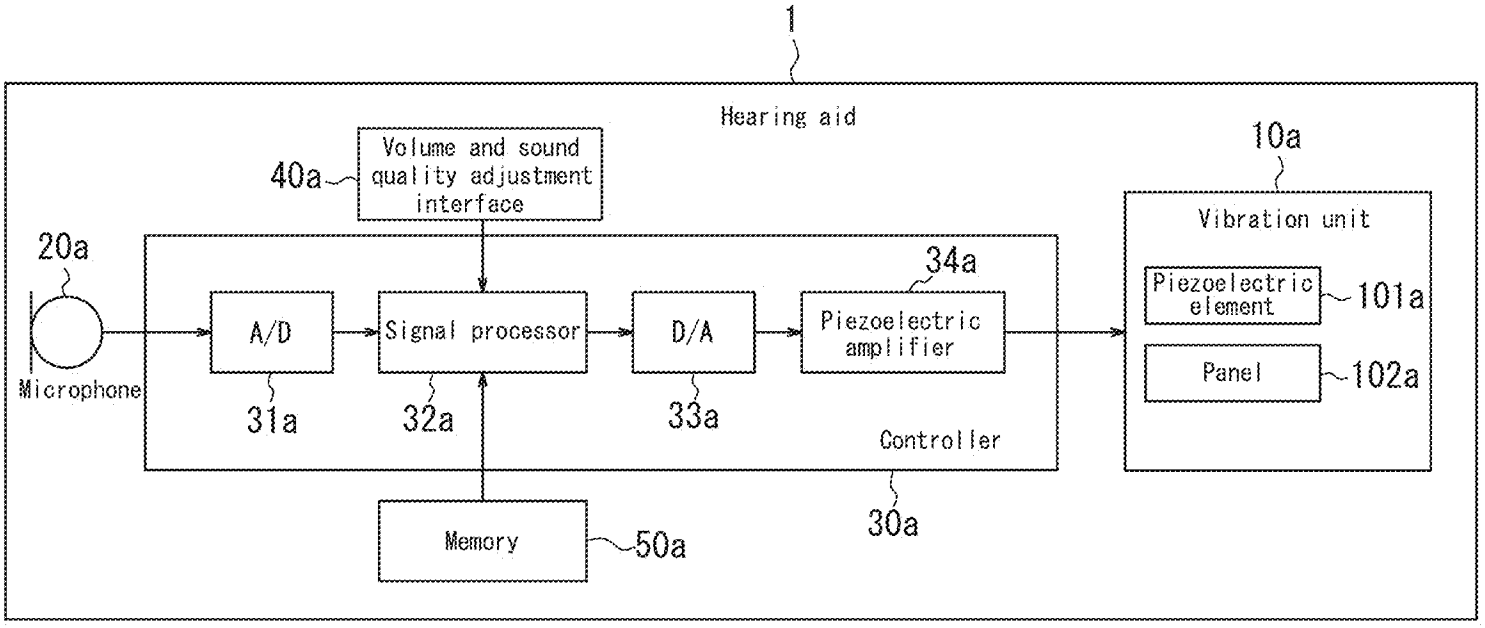
FIG. 8 is a block diagram illustrating an acoustic device according to Embodiment 1.

Next, the acoustic device of this disclosure is described. FIG. 8 is a block diagram of an acoustic device 1 according to one of the disclosed embodiments. The acoustic device 1 is, for example, a hearing aid 1 and includes a vibrating body 10*a*, a microphone 20*a*, a controller 30*a*, a volume and sound quality adjustment interface 40*a*, and a memory 50*a*.

Figure 9A:
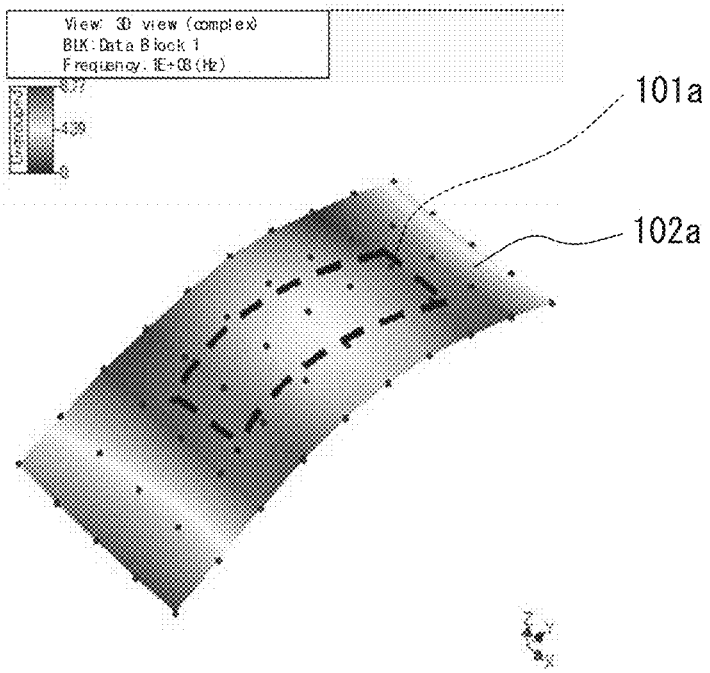
FIGS. 9A and 9B schematically illustrate flexure of a panel and a piezoelectric element in the acoustic device according to Embodiment 1.
Figure 9B:
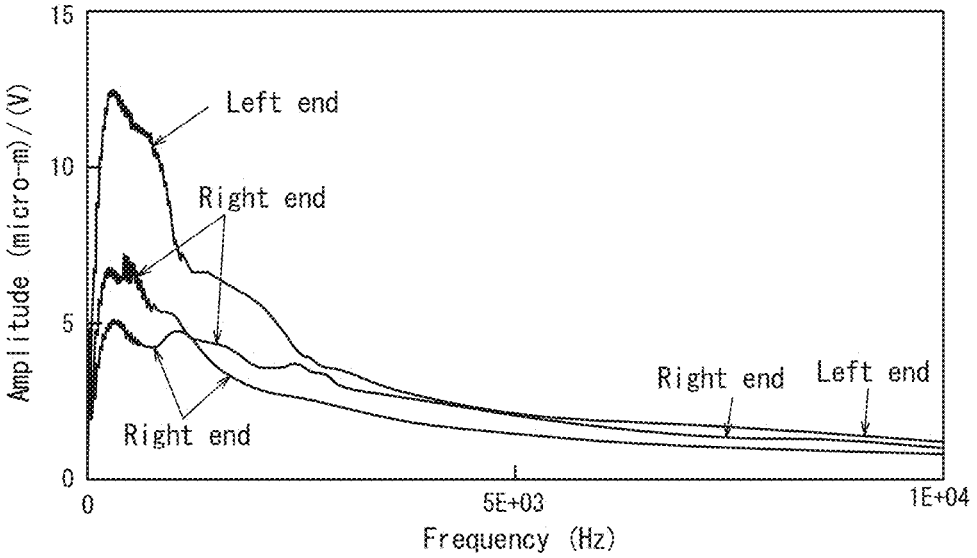

The vibrating body 10*a* includes a piezoelectric element 101*a* that flexes and a panel 102*a* that vibrates by being bent directly by the piezoelectric element 101*a*. FIG. 9A schematically illustrates flexing of the panel 102*a* due to the piezoelectric element 101*a*. The vibrating body 10*a* causes the user to hear air-conducted sound and human body vibration sound due to vibration. FIG. 9B illustrates the amount of displacement in the z-direction at one end of the panel 102*a* (the left end in FIG. 9A), the central region, and the other end (the right end in FIG. 9A) when the panel 102*a* is bent by the piezoelectric element 101*a*. As illustrated in FIG. 9B, the amount of displacement in the z-direction varies by position along the panel 102*a*. It is therefore clear that the panel 102*a* undulates.

The piezoelectric element 101*a* is formed by elements that, upon application of an electric signal (voltage), either expand and contract or bend (flex) in accordance with the electromechanical coupling coefficient of their constituent material. Ceramic or crystal elements, for example, may be used. The piezoelectric element 101*a* may be a unimorph, bimorph, or laminated piezoelectric element. Examples of a laminated piezoelectric element include a laminated unimorph element with layers of unimorph (for example, 16 or 24 layers) and a laminated bimorph element with layers of bimorph (for example, 16 or 24 layers). Such a laminated piezoelectric element may be configured with a laminated structure formed by a plurality of dielectric layers composed of, for example, lead zirconate titanate (PZT) and electrode layers disposed between the dielectric layers. Unimorph expands and contracts upon the application of an electric signal (voltage), and bimorph bends upon the application of an electric signal (voltage). The surface of the piezoelectric element 101*a* that contacts the panel 102*a* (principal surface) preferably has a width of 4.0 mm and a length of 17.5 mm. The principal surface of the piezoelectric element 101*a* is described below as having a width of 4.0 mm and a length of 17.5 mm.

The panel 102*a* is, for example, made from glass or a synthetic resin such as acrylic or the like. An exemplary shape of the panel 102*a* is a plate, and the shape of the panel 102*a* is described below as being a plate.

The microphone 20*a* collects sound from a sound source, namely sound reaching the user's ear.

The controller 30*a* executes various control pertaining to the hearing aid 1. The controller 30*a* applies a predetermined electric signal (a voltage corresponding to a sound signal) to the piezoelectric element 101*a*. In greater detail, in the controller 30*a*, an A/D converter 31 converts a sound signal collected by the microphone 20*a* into a digital signal. Based on information on volume, sound quality, and the like from the volume and sound quality adjustment interface 40*a* and on information stored in the memory 50*a*, a signal processor 32 outputs a digital signal that drives the vibrating body 10*a*. A D/A converter 33*a* converts the digital signal to an analog electric signal, which is then amplified by a piezoelectric amplifier 34. The resulting electric signal is applied to the piezoelectric element 101*a*. The voltage that the controller 30*a* applies to the piezoelectric element 101*a* may, for example, be ±15 V. This is higher than ±5 V, i.e. the applied voltage of a so-called panel speaker for conduction of sound by air-conducted sound rather than human body vibration sound. In this way, sufficient vibration is generated in the panel 102*a*, so that a human body vibration sound can be generated via a part of the user's body. Note that the magnitude of the applied voltage used may be appropriately adjusted in accordance with the fixation strength of the panel 102*a* or the performance of the piezoelectric element 101*a*. Upon the controller 30*a* applying the electric signal to the piezoelectric element 101*a*, the piezoelectric element 101*a* expands and contracts or bends in the longitudinal direction.

At this point, the panel 102*a* to which the piezoelectric element 101*a* is attached vibrates by deforming in conjunction with the expansion and contraction or bending of the piezoelectric element 101*a*. The panel 102*a* flexes due to expansion and contraction or to bending of the piezoelectric element 101*a*. The panel 102*a* is bent directly by the piezoelectric element 101*a*. Stating that "the panel 102*a* is bent directly by the piezoelectric element 101*a*" differs from the phenomenon utilized in known panel speakers, whereby the panel 102*a* deforms upon vibration of a particular region of the panel 102*a* due to the inertial force of a piezoelectric actuator constituted by disposing the piezoelectric element 101*a* in the casing. Stating that "the panel 102*a* is bent directly by the piezoelectric element 101*a*" refers instead to how expansion and contraction or bending (flexure) of the piezoelectric element 101*a* directly bends the panel 102*a* via the joining member.

Since the panel 102*a* vibrates as described above, the panel 102*a* generates air-conducted sound, and when the user contacts the panel 102*a* to the tragus, the panel 102*a* generates human body vibration sound via the tragus. The panel 102*a* preferably vibrates with locations near the edges of the panel 102*a* as nodes and the central region as an antinode, and a location at the central region of the panel 102*a* preferably contacts the tragus or antitragus. As a result, vibration of the panel 102*a* can be efficiently transmitted to the tragus or the antitragus.

Figure 10:
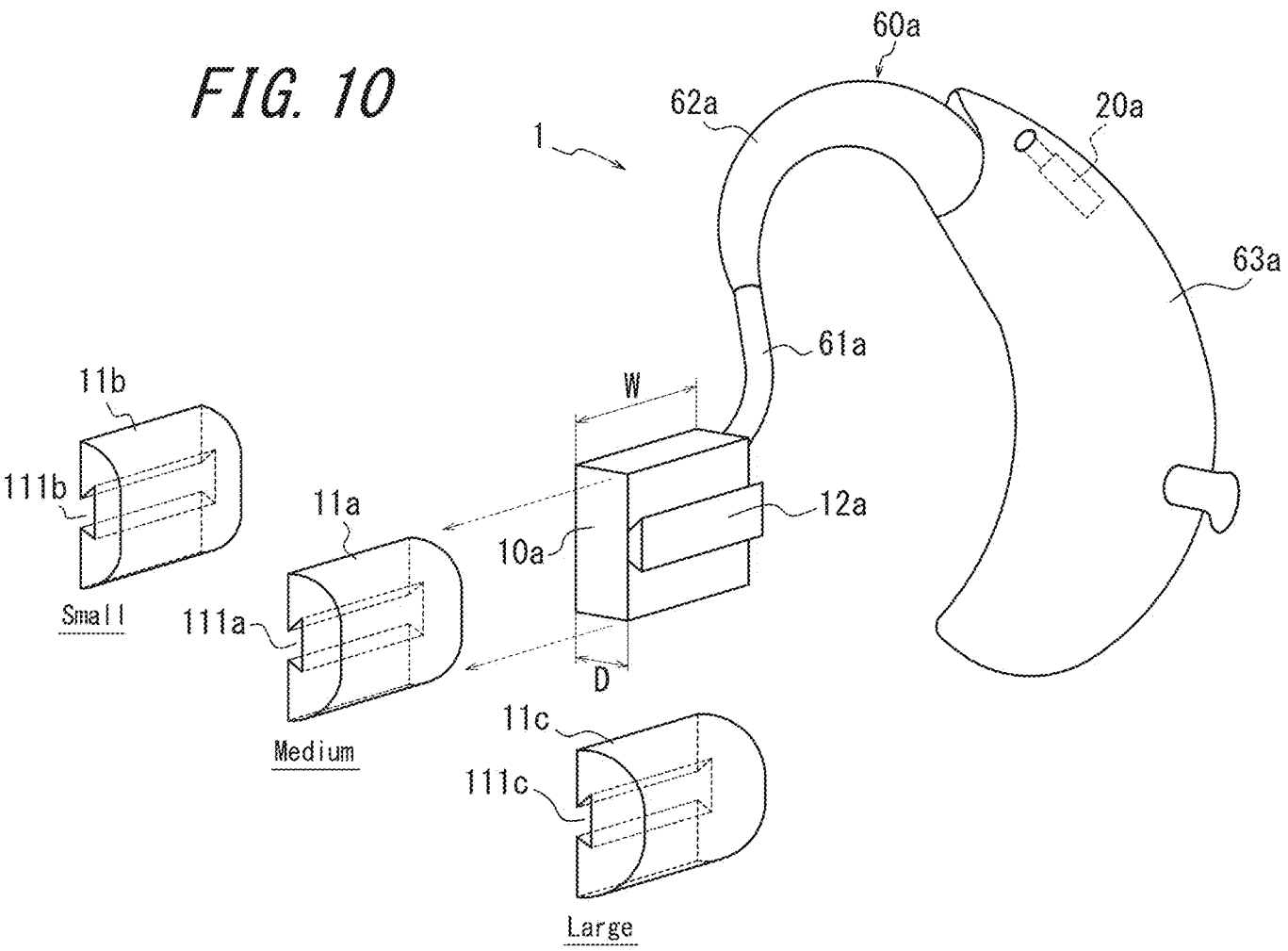
FIG. 10 illustrates the state of an acoustic device when a pressing member is detached.

FIG. 10 schematically illustrates the structure of the hearing aid 1 according to one of the disclosed embodiments. As illustrated in FIG. 10, the vibrating body 10*a* includes a pressing member 11*a* and an attaching portion 12*a* for the pressing member. The pressing member 11*a* is attached to the vibrating body 10*a*. For example when the vibrating body 10*a* contacts the user's tragus, then by the pressing member 11*a* contacting a portion of the external ear canal opposite the tragus, for example a location near the antitragus, the pressing member 11*a* presses the vibrating body 10*a* into the position of contact with the tragus. The position where the vibrating body 10*a* contacts the user's ear may, for example, be the tragus, antitragus, concha auriculae, or auricle. In this embodiment, an example is described in which the position of contact with the user's ear is the tragus (the inner wall of the external ear canal by the tragus).

The attaching portion 12*a* for the pressing member is a member for attaching the pressing member 11*a* to the vibrating body 10*a*. The pressing member 11*a* and the attaching portion 12*a* are shaped to fit each other. The pressing member 11*a* preferably includes a concave cutout portion 111*a*, and the attaching portion 12*a* preferably has a convex shape that fits into the cutout portion 111*a*. The pressing member 11*a* can be detached from the vibrating body 10*a* by sliding in the width direction. The vibrating body 10*a* preferably has a thickness (D) of 4 mm or less and a width (W) of 15 mm or less. If the size is within this range, the vibrating body 10*a* can fit within the external ear canal of the user's ear regardless of gender or age (except for toddlers and below). The pressing member 11*a* also preferably comes in three sizes (small, medium, and large), with one of the pressing members 11*a*, 11*b*, and 11*c* being selected in accordance with the size of the user's ear and attached to the attaching portion 12*a* for the pressing member.

A holder 60*a* includes a support 61*a*, an ear hook 62*a*, and a body 63*a*. The holder 60*a* holds the vibrating body 10*a* at the position at which the vibrating body 10*a* contacts the user's ear (the inner wall of the external ear canal by the tragus). One end of the support 61*a* is connected to the vibrating body 10*a*. The support 61*a* has a hollow structure, and a lead wire is fed to the vibrating body 10*a* through this hollow structure. The support 61*a* is rigid enough so that the angle of the vibrating body 10*a* does not change. The other end of the support 61*a* is connected to one end of the ear hook 62*a*.

The ear hook 62*a* contacts the outside of the user's auricle to mount the hearing aid 1 in the user's ear. The ear hook 62*a* is preferably shaped as a hook conforming to the user's auricle so as to mount the hearing aid 1 stably in the user's ear. The other end of the ear hook 62*a* is connected to the body 63*a*. The body 63*a* stores the microphone 20*a*, controller 30*a*, volume and sound quality adjustment interface 40*a*, and memory 50*a* therein.

Figure 11:
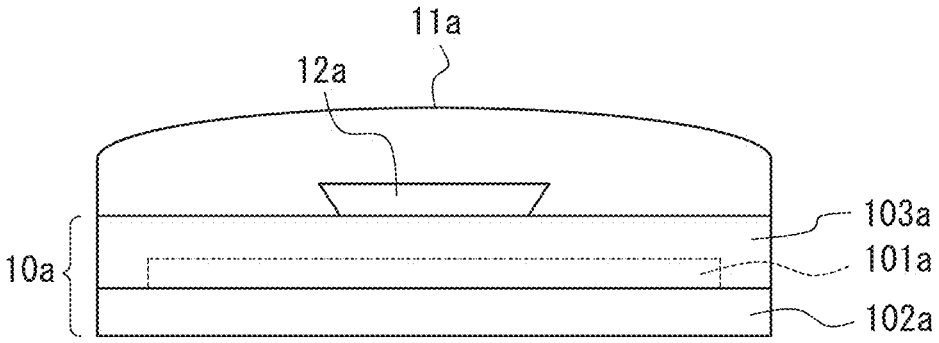
FIG. 11 is a side view of the acoustic device according to Embodiment 1 in the thickness direction of the vibrating body.

FIG. 11 is a side view of the vibrating body 10*a* as viewed in the thickness direction. As described above, the vibrating body 10*a* includes the piezoelectric element 101*a* and the panel 102*a*. The piezoelectric element 101*a* is preferably shaped as a plate, as in FIG. 11.

The piezoelectric element 101*a* is joined to the panel 102*a* by a joining member. The joining member is disposed between the principal surface of the piezoelectric element 101*a* and the principal surface of the panel 102*a*. The joining member is preferably a non-heat hardening adhesive material or double-sided tape.

Apart from the surface joined to the panel 102*a*, the piezoelectric element 101*a* is covered by a mold 103*a*. The pressing member 11*a* and the attaching portion 12*a* for the pressing member are provided at the top of the mold 103*a*.

The surface of the panel 102*a* that contacts the ear (principal surface) preferably has an area between 0.8 and 10 times the area of the principal surface of the piezoelectric element 101*a*. If the principal surface of the panel 102*a* has an area between 0.8 and 10 times the area of the principal surface of the piezoelectric element 101*a*, the panel 102*a* can deform in conjunction with expansion and contraction or bending of the piezoelectric element 101*a*, and the area of contact with the user's ear can be sufficiently guaranteed. The area of the panel is, for example, more preferably between 0.8 and 5 times the area of the piezoelectric element. Accordingly, the principal surface of the panel 102*a* for example has a width of 10 mm and a length of 18 mm. The principal surface of the panel 102*a* is described below as having a width of 10 mm and a length of 18 mm.

Figure 12B:
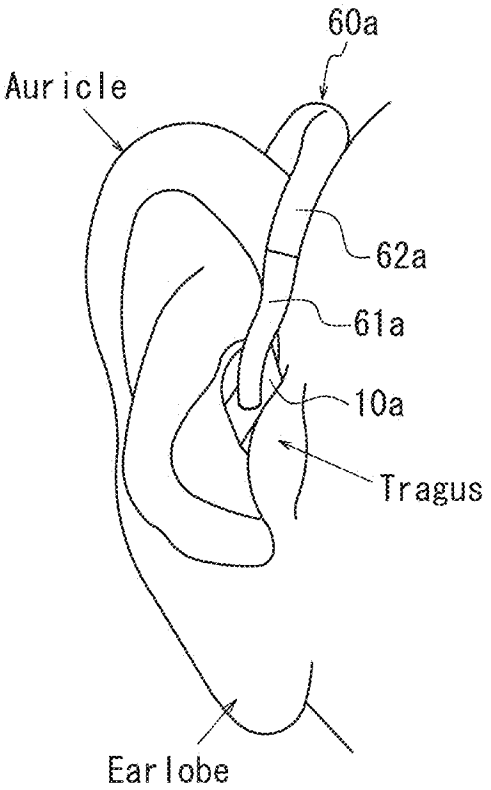
FIGS. 12A and 12B illustrate the acoustic device according to Embodiment 1 as worn in a user's ear.
Figure 12A:
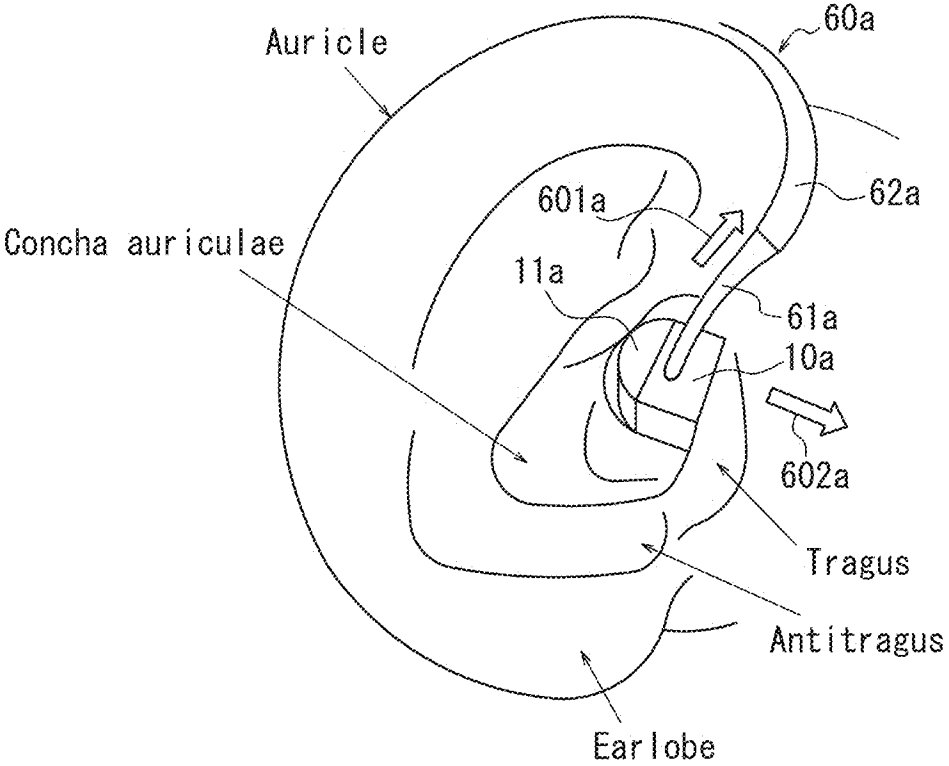

FIGS. 12A and 12B illustrate the hearing aid 1 according to one of the disclosed embodiments as worn in the user's ear. FIG. 12A is a front view of the ear, and FIG. 12B is a side view of the ear from the face. The hearing aid 1 causes the user to hear sound by contacting the vibrating body 10*a* to the user's tragus or antitragus from inside the user's ear and transmitting vibration to the tragus or the antitragus. Stating that the vibrating body 10*a* is "contacted to the user's tragus or antitragus from inside the user's ear" refers to how, when buried in the external ear canal, the vibrating body 10*a* is contacted to the tragus or antitragus from a position near the entrance of the external ear canal. In the example in FIGS. 12A and 12B, the vibrating body 10*a* is contacted to the user's tragus from inside the user's ear. At this time, the pressing member 11*a* contacts a portion of the external ear canal opposite the tragus.

The vibrating body 10*a* illustrated in FIG. 12A is pulled via the support 61*a* in the direction of the arrow 601 by the weight of the holder 60*a*, i.e. by the weight of the body 63*a* connected to the end of the ear hook 62*a*. As illustrated in FIG. 12B, since the vibrating body 10*a* contacts the tragus so as to be caught by the tragus, a force acts in the direction in which the vibrating body 10*a* contacts the user's ear (the direction of the arrow 602) when the vibrating body 10*a* is pulled. In other words, by the weight of the holder 60*a*, a force (pressing force) is produced in the direction in which the vibrating body 10*a* contacts the user's ear. The holder 60*a* thus causes a pressing force to act on the vibrating body 10*a*, thereby more reliably transmitting sound by vibration of the vibrating body 10*a*.

The vibrating body 10*a* is preferably pressed against the user's ear with a force of 0.1 N to 3 N. If the vibrating body 10*a* is pressed with a force between 0.1 N and 3 N, vibration by the vibrating body 10*a* is sufficiently transmitted to the ear. Furthermore, if the pressure is a small force of less than 3 N, the user suffers little fatigue even when wearing the hearing aid 1 for an extended period of time, thus maintaining a sense of comfort when wearing the hearing aid 1.

As also illustrated in FIG. 12A, the hearing aid 1 does not completely seal the external ear canal with the vibrating body 10*a* and the pressing member 11*a*. Therefore, the hearing aid 1 does not cause an occlusion effect and remains comfortable when worn.

Next, the acoustic characteristics of the hearing aid 1 according to one of the disclosed embodiments are described with reference to FIGS. 13 through 15.

Figure 13:
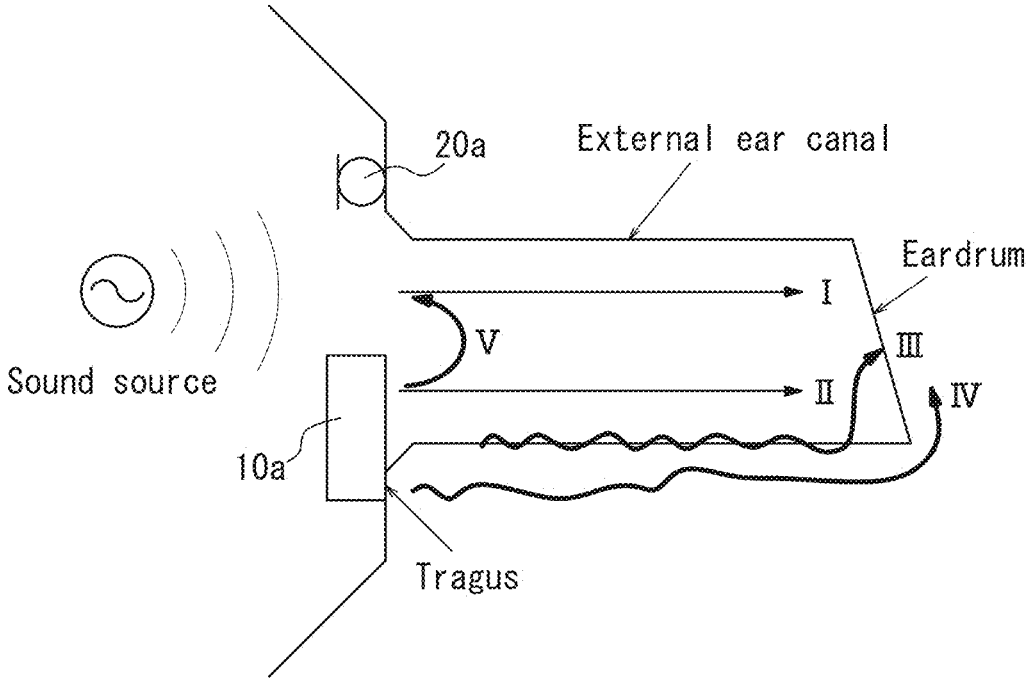
FIG. 13 schematically illustrates transmission of sound from the acoustic device according to Embodiment 1.

FIG. 13 schematically illustrates transmission of sound from the hearing aid 1 according to one of the disclosed embodiments. In FIG. 13, the only illustrated portions of the hearing aid 1 are the vibrating body 10*a* and the microphone 20*a*. The microphone 20*a* collects sound from a sound source. By vibrating, the vibrating body 10*a* causes the user to hear the sound collected by the microphone 20*a*.

As illustrated in FIG. 13, sound from the sound source passes through the external ear canal from a portion not covered by the vibrating body 10*a* and reaches the eardrum directly (path I). Air-conducted sound due to vibration of the vibrating body 10*a* also passes through the external ear canal and reaches the eardrum (path II). Due to the vibration of the vibrating body 10*a*, at least the inner wall of the external ear canal vibrates, and air-conducted sound due to this vibration of the external ear canal (external ear canal radiated sound) reaches the eardrum (path III). Furthermore, human body vibration sound due to the vibration of the vibrating body 10*a* reaches the auditory nerve directly without passing through the eardrum (path IV). A portion of the air-conducted sound produced by the vibrating body 10*a* escapes to the outside (path V).

Figure 14A:
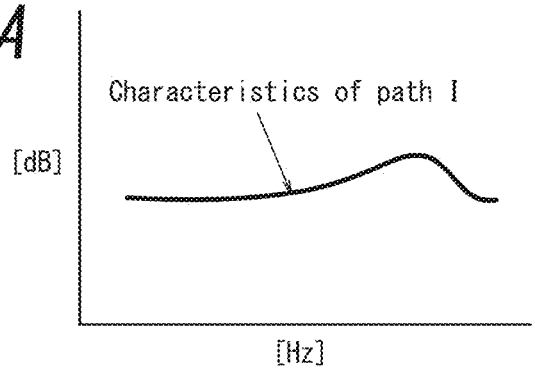
FIGS. 14A through 14D schematically illustrate acoustic characteristics of various paths.
Figure 14B:
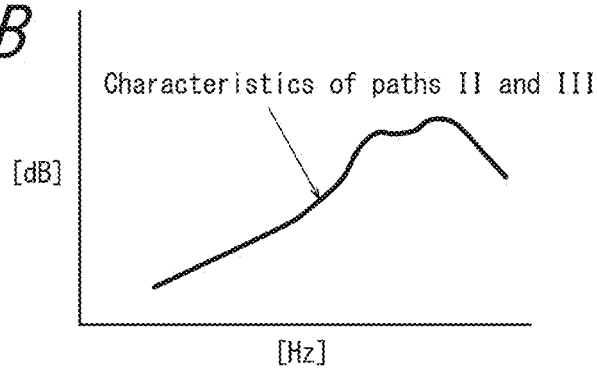
Figure 14C:
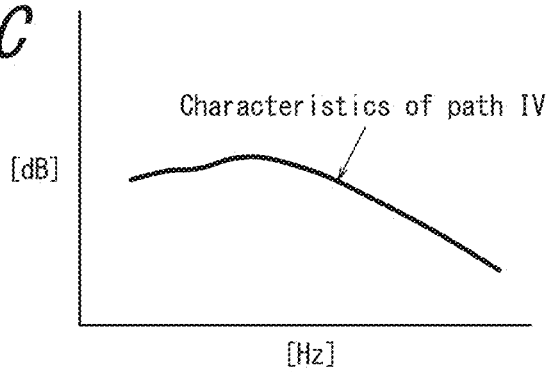
Figure 14D:
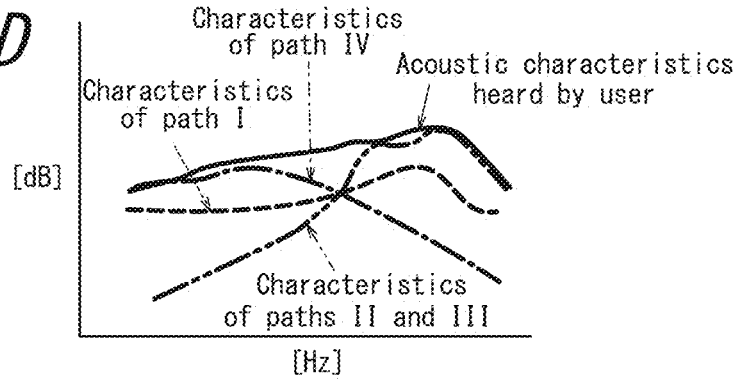

FIGS. 14A through 14D schematically illustrate the acoustic characteristics of the various paths. FIG. 14A illustrates the acoustic characteristics of sound by path I, and FIG. 14B illustrates the acoustic characteristics of sound by path II and path III. For the sound by path II and path III, the sound pressure in the low-frequency sound region is low, since low-frequency sound escapes by path V. FIG. 14C illustrates the acoustic characteristics of path IV. As illustrated in FIG. 14C, the human body vibration sound is low-frequency sound, i.e. vibration in a low-frequency region. Therefore, this sound does not dampen easily and hence is transmitted more easily than high-frequency sound. Accordingly, low-frequency sound is transmitted relatively well. FIG. 14D illustrates the acoustic characteristics for a combination of sounds by paths I through IV, i.e. the actual acoustic characteristics heard by a user wearing the hearing aid 1. As illustrated in FIG. 14D, even though sound pressure of low-frequency sound escapes to the outside by path V, the sound pressure of low-frequency sound, namely sound pressure of low-frequency sound at 1 kHz or less in this embodiment, can be guaranteed by the human body vibration sound, thereby maintaining a sense of volume.

Figure 15:
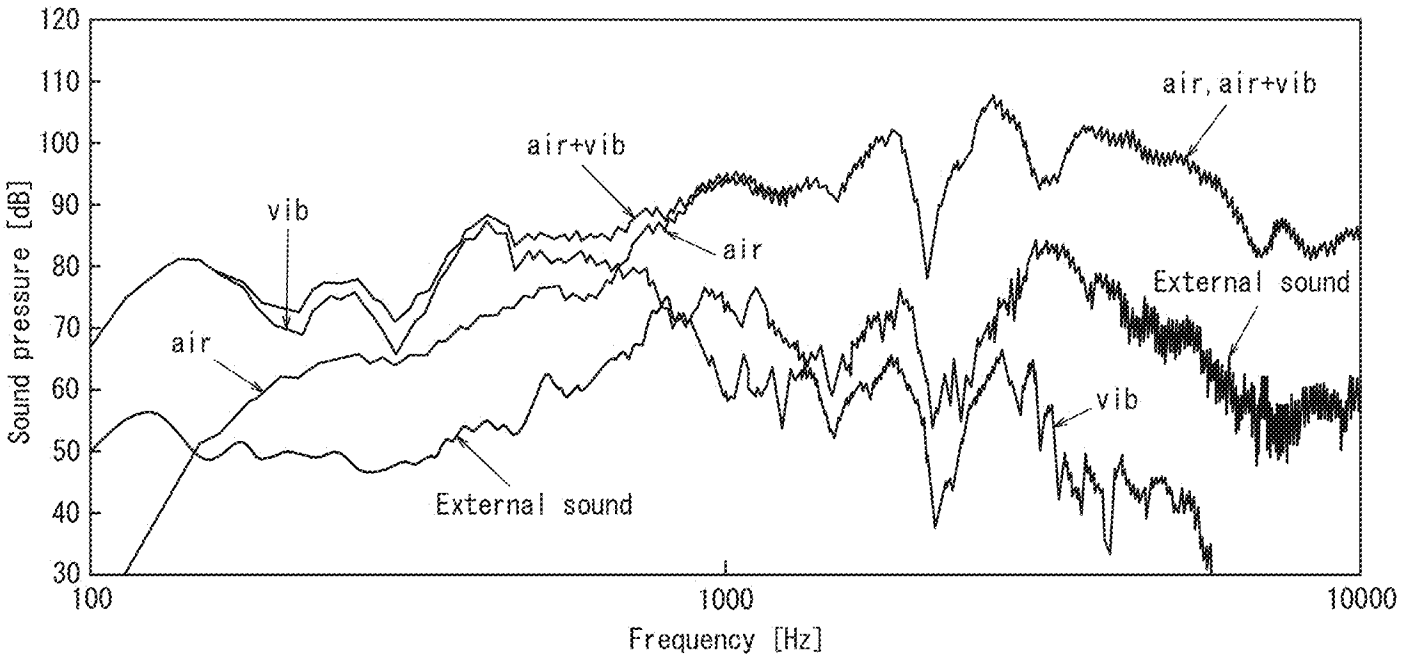
FIG. 15 illustrates measured values of the acoustic characteristics of the acoustic device according to Embodiment 1.

FIG. 15 illustrates measured values of the frequency characteristics of the hearing aid 1. In FIG. 15, "air" represents the frequency characteristics of sound by path II and path III in FIG. 13, and "vib" represents the frequency characteristics of sound by path IV in FIG. 13. Furthermore, "air+vib" represents the frequency characteristics of sound yielded by combining the sound of path II through path IV. Finally, "external sound" represents the frequency characteristics of sound over path I in FIG. 13. As indicated by these measurement values, the sound pressure of low-frequency sound is transmitted by the human body vibration sound, thereby suppressing a loss in the sense of volume.

Figure 16A:
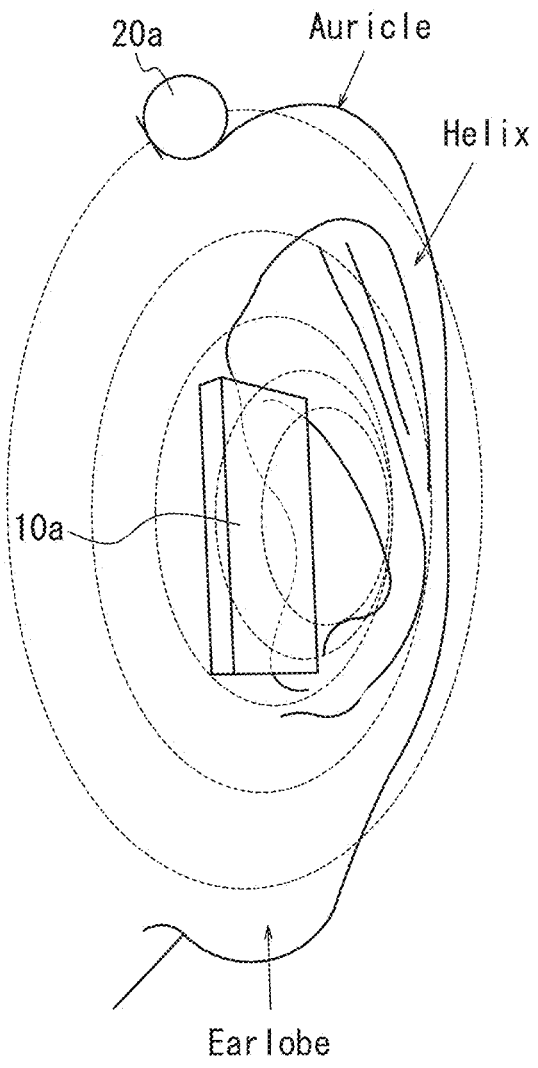
FIGS. 16A and 16B illustrate the relationship between the vibrating body and the microphone in the acoustic device according to Embodiment 1.
Figure 16B:
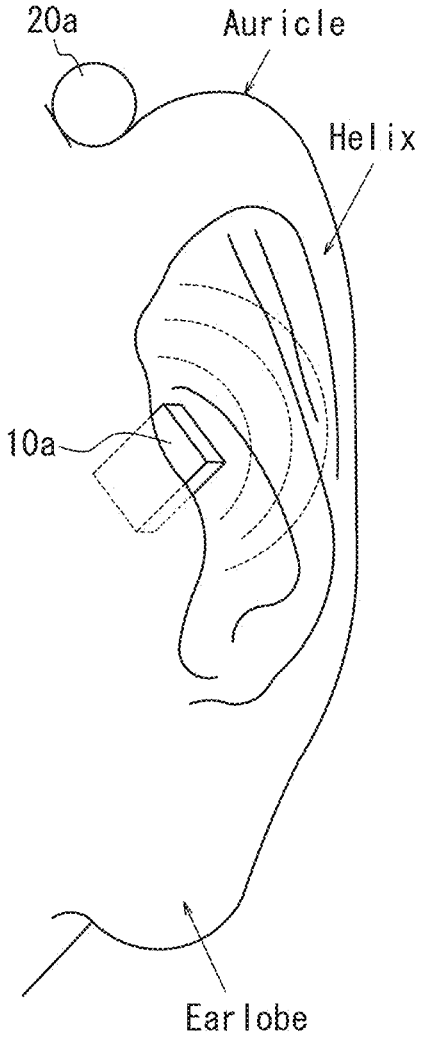

FIGS. 16A and 16B illustrate the relationship between the vibrating body 10*a* and the microphone 20*a* in the hearing aid 1 according to one of the disclosed embodiments. The microphone 20*a* is provided in the body 63*a* of the holder 60*a* and is therefore positioned on the outside of the auricle. FIG. 16A illustrates an example in which the vibrating body 10*a* is contacted to the user's tragus from outside the user's ear. In this case, nothing blocks the air-conducted sound generated by the vibrating body 10*a* from reaching the microphone 20*a*. Therefore, a large amount of sound returns to the microphone 20*a*, easily leading to howling and preventing improvement in the performance (amplification) of the hearing aid 1.

Conversely, the vibrating body 10*a* is contacted to the user's tragus from inside the user's ear in FIG. 16B. In this case, the user's ear (mainly the tragus and the crus of helix) is positioned between the microphone 20*a* and the vibrating body 10*a*. Therefore, sound generated by the vibrating body

10*a* is reflected by the user's ear, so that the amount of sound returning directly to the microphone 20*a* is less than in FIG. 16A. As a result, howling is less likely to occur, and the performance of the hearing aid 1 can be improved.

As preferred examples of the user's ear position, it suffices for a peripheral portion of the ear, such as the helix, auricular tubercle, earlobe, or the like to be located between the microphone 20*a* and the vibrating body 10*a*. Alternatively, apart from a peripheral portion, the inferior antihelix crus, antihelix, or the like may be located between the microphone 20*a* and the vibrating body 10*a*.

According to the hearing aid 1, vibration of the vibrating body 10*a* causes the user's ear to hear sound. Sound pressure of low-frequency sound can thus be ensured by the human body vibration sound, suppressing a loss in the sense of volume. Furthermore, since it is unnecessary to provide a vent for preventing low-frequency sound from escaping, a loss in the sense of comfort when wearing the hearing aid 1 can be suppressed.

Measurement of Acoustic Device with Measurement System

Next, the results of measuring the acoustic device 1 with the above-described measurement system 10 are described. The vibrating body 10*a* of the acoustic device 1 is preferably pressed against the ear model 50 of the measurement system 10 with a force of 0.05 N to 3 N. This is the range over which the vibrating body 10*a* of the acoustic device 1 is pressed against a human ear. The vibrating body 10*a* is more preferably pressed against the ear model 50 with a force of 0.1 N to 2 N. This is the range over which the vibrating body 10*a* of the acoustic device 1 is likely to be pressed against a human ear. In other words, pressing the vibrating body 10*a* against the ear model 50 with a force of 0.1 N to 2 N yields measurement results more closely conforming to the actual form of use.

The area of the vibrating body 10*a* of the acoustic device 1 that contacts the ear model 50 of the measurement system 10 (contact area) is preferably from 0.1 $cm^2$ to 4 $cm^2$. This range of contact area is the range over which the vibrating body 10*a* of the acoustic device 1 contacts a human ear. The contact area is more preferably from 0.3 $cm^2$ to 3 $cm^2$. This is the range over which the vibrating body 10*a* of the acoustic device 1 is likely to contact a human ear. In other words, setting the contact area to be from 0.3 $cm^2$ to 3 $cm^2$ cm yields measurement results more closely conforming to the actual form of use.

Figure 17:
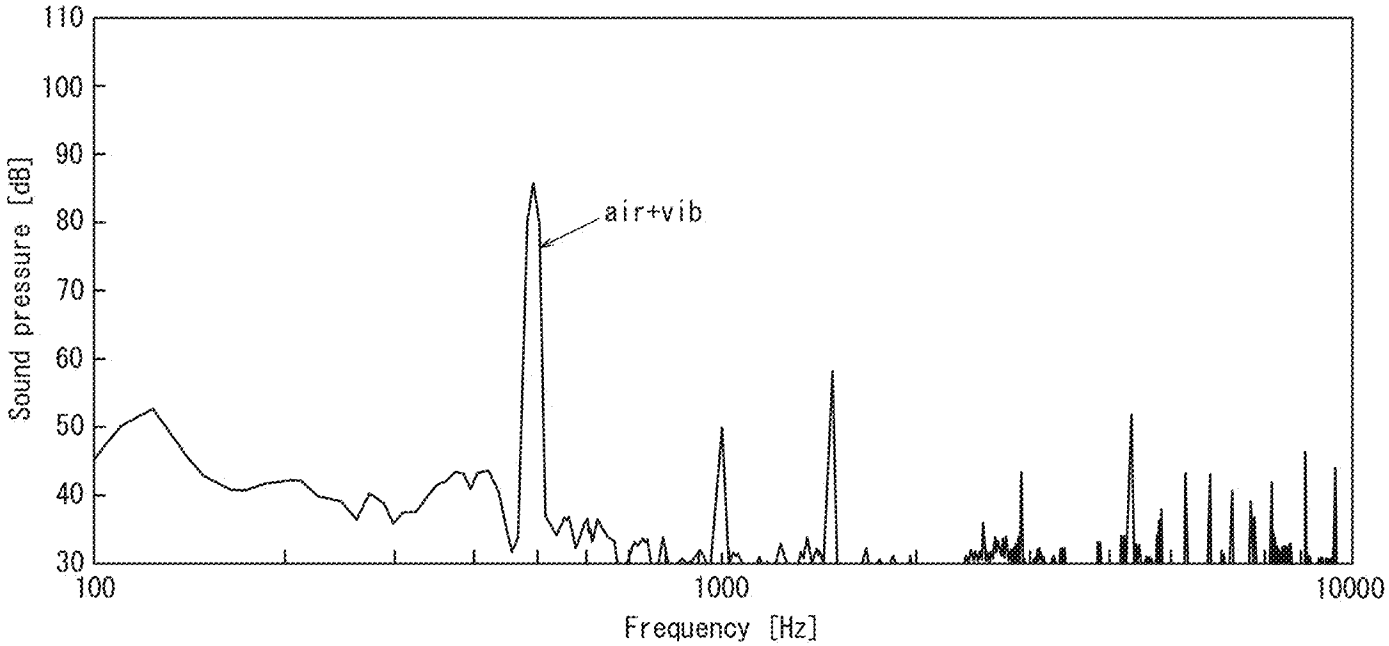
FIG. 17 illustrates the measurement results, using the measurement system according to Embodiment 1, for air-conducted sound and human body vibration sound from an acoustic device.
Figure 18:
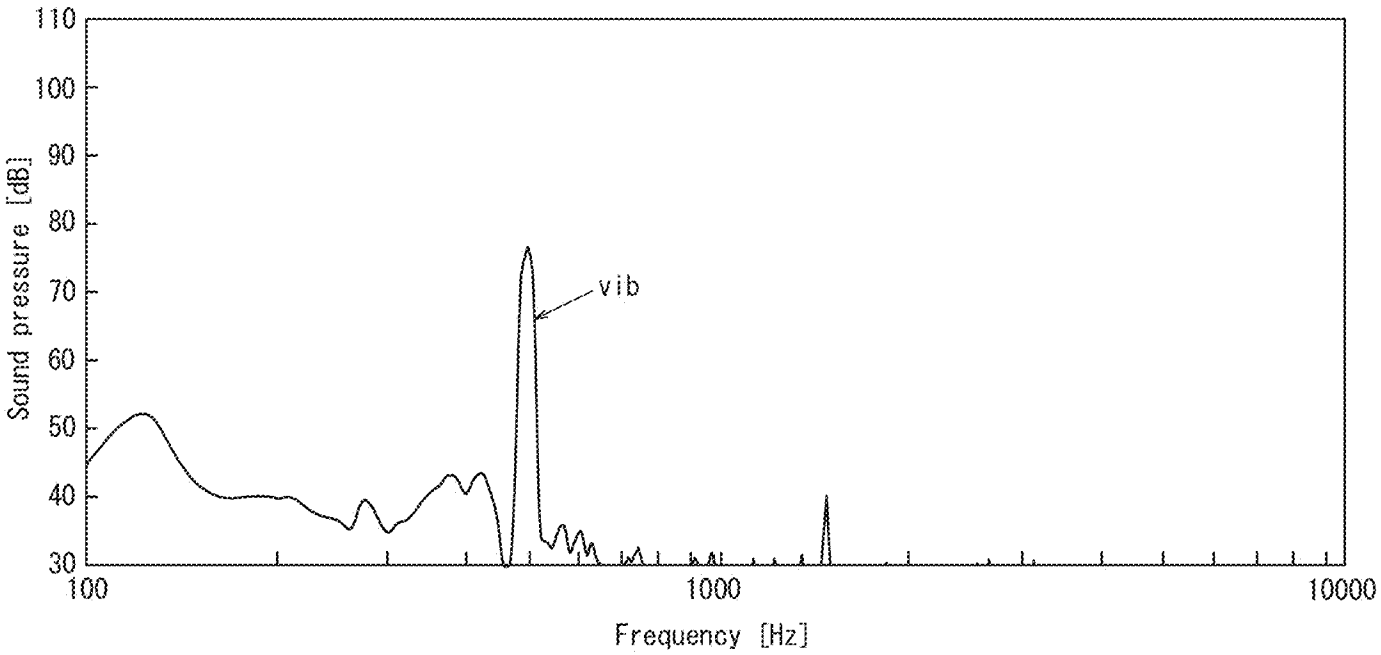
FIG. 18 illustrates the measurement results, using the measurement system according to Embodiment 1, for human body vibration sound from an acoustic device.
Figure 19:
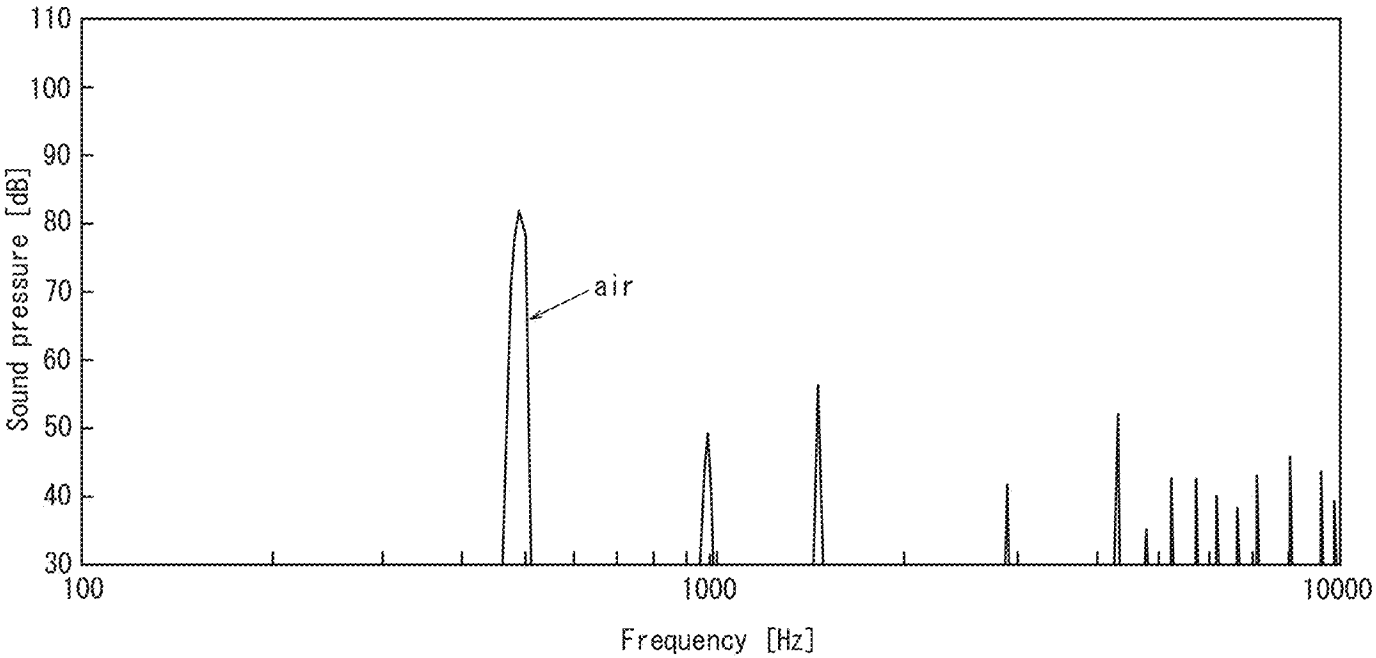
FIG. 19 illustrates the measurement results, using the measurement system according to Embodiment 1, for air-conducted sound from an acoustic device.

FIGS. 17 to 19 illustrate the power spectrum of air-conducted sound and/or human body vibration sound measured by the measurement system 10 when the vibrating body 10*a* of the acoustic device 1 outputs a fundamental frequency of 500 Hz while placed in contact with the tragus of the ear model 50 in the measurement system 10.

FIG. 17 illustrates the power spectrum of sound yielded by combining air-conducted sound and human body vibration sound. As illustrated in FIG. 17, a power spectrum in which a plurality of harmonics appear in addition to the fundamental frequency of 500 Hz is measured. In greater detail, the second harmonic (1000 Hz) and third harmonic (1500 Hz) appear. A plurality of harmonics at or above the sixth harmonic are also measured. The number of harmonics for which the signal-to-noise ratio (S/N) is 10 dB or more above the noise floor is counted. Upon counting the number of harmonics in this way, three or more harmonics that are at or above the sixth harmonic and that have a volume exceeding a volume 45 dB below the volume of the fundamental frequency are measured. A volume exceeding a volume 45 dB below the fundamental frequency means that, for example for a fundamental frequency at 90 dB, the volume exceeds 45 dB. A harmonic for which the signal-to-noise ratio (S/N) is 10 dB or more above the noise floor means that, for example for a noise floor of 25 dB, the volume of the harmonic is 35 dB or more.

In FIG. 17, three or more harmonics at or above the sixth harmonic and exceeding a volume that is half of the volume of the fundamental frequency are also measured. A volume that is half of the volume of the fundamental frequency means that, for example when the fundamental frequency is 90 dB, the volume is half of 90 dB, i.e. 45 dB. In this case, the harmonics that are counted in the combined sound are subjected to the condition of the sound (air+vib) that is a combination of the vibration component and the air-conducted component in the fundamental frequency being 75 dB or greater. Alternatively, the harmonics counted in the air-conducted sound may be subjected to the condition of the sound (air) of the air-conducted component in the fundamental frequency being 70 dB or greater.

Next, FIG. 18 illustrates the power spectrum of human body vibration sound. As illustrated in FIG. 18, although the fundamental frequency of 500 Hz is measured, nearly no harmonics occur. In other words, unlike FIG. 17, three or more harmonics at or above a sixth harmonic and having a measured value exceeding a value 50 dB below the measured value of the fundamental frequency are not measured in the measurement results of FIG. 18. Furthermore, three or more harmonics at or above the sixth harmonic and exceeding a value that is half of the measured value of the fundamental frequency are not measured. The human body vibration sound referred to here is not the vibration energy generated by the panel 102*a* (conceptually, at least III and IV in FIG. 13). In other words, among the vibration energy generated by the panel 102*a*, the human body vibration sound referred to here is the component measured by the vibration detection element 56 (conceptually, IV in FIG. 13) excluding components such as the energy converted to an air-conducted component in the artificial external ear canal 52 or the like (conceptually, III in FIG. 13). It is thus clear that people do not hear sufficient harmonics via the vibration component.

Next, FIG. 19 illustrates the power spectrum of air-conducted sound. As illustrated in FIG. 19, a power spectrum in which a plurality of harmonics appear in addition to the fundamental frequency of 500 Hz is measured. In greater detail, the second harmonic (1000 Hz) and third harmonic (1500 Hz) appear. Furthermore, a plurality of harmonics are measured at or above the sixth harmonic, and three or more harmonics that are at or above the sixth harmonic and that have a volume exceeding a volume 45 dB below the volume of the fundamental frequency are measured. In FIG. 17, three or more harmonics at or above the sixth harmonic and exceeding a volume that is half of the volume of the fundamental frequency are also measured. The air-conducted sound referred to here is the air-conducted sound measured by the microphone 62 and therefore is the combined volume of the component emitted from the panel 102*a* as air-conducted sound and the air-conducted sound component converted to air-conducted sound at the inner wall of the artificial external ear canal (II and III in FIG. 13).

It is thus clear that harmonics in the power spectrum are produced by air-conducted sound and are not produced much by the human body vibration sound.

While the results for removing the ear model 50 from the measurement system to expose the microphone 62 and measuring only the component generated by the panel 102*a* as air-conducted sound (conceptually, II in FIG. 13) are not illustrated, experiments showed that in the panel 102*a* with the above-described size, the air-conducted sound corresponding to II in FIG. 13 is sufficiently small with respect to III in FIG. 3, and hence the effect on human hearing can be ignored. Note that the air-conducted sound (conceptually, II in FIG. 13) being sufficiently small is not being identified as problematic; rather, the finding being reported is that this air-conducted sound is actually sufficiently small (for example, air-conducted sound (in FIG. 13)). Accordingly, it is also acceptable if the acoustic device itself can produce harmonics via air-conducted sound (II in FIG. 13).

Therefore, from the above-described results, it is thought that at least among the vibration component generated by the panel 102*a*, the component converted to air-conducted sound (III in FIG. 13) fulfills a central role in generating harmonics. It is also inferred that the harmonics are largely generated at the artificial auricle or the artificial external ear canal.

Figure 20:
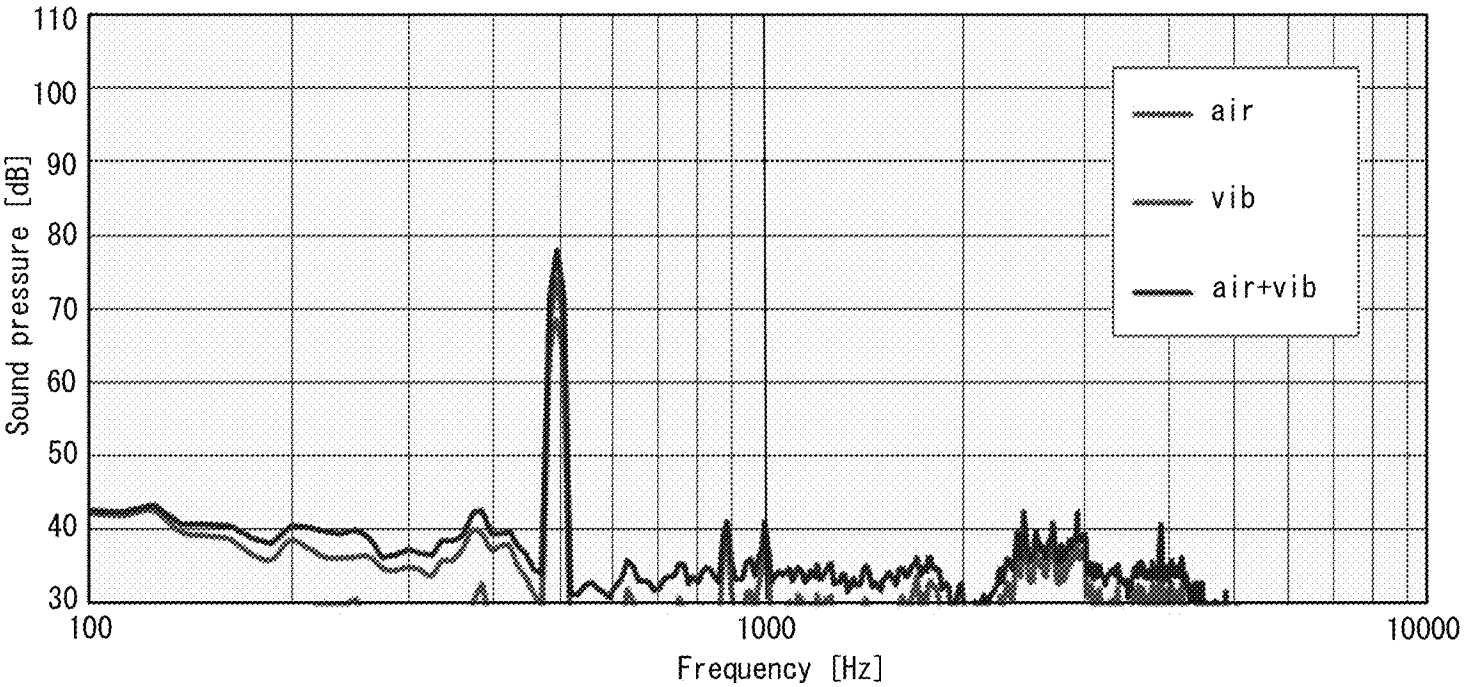
FIG. 20 illustrates the measurement results, using a comparative example (known technique), for air-conducted sound and human body vibration sound from an acoustic device.
Figure 21:
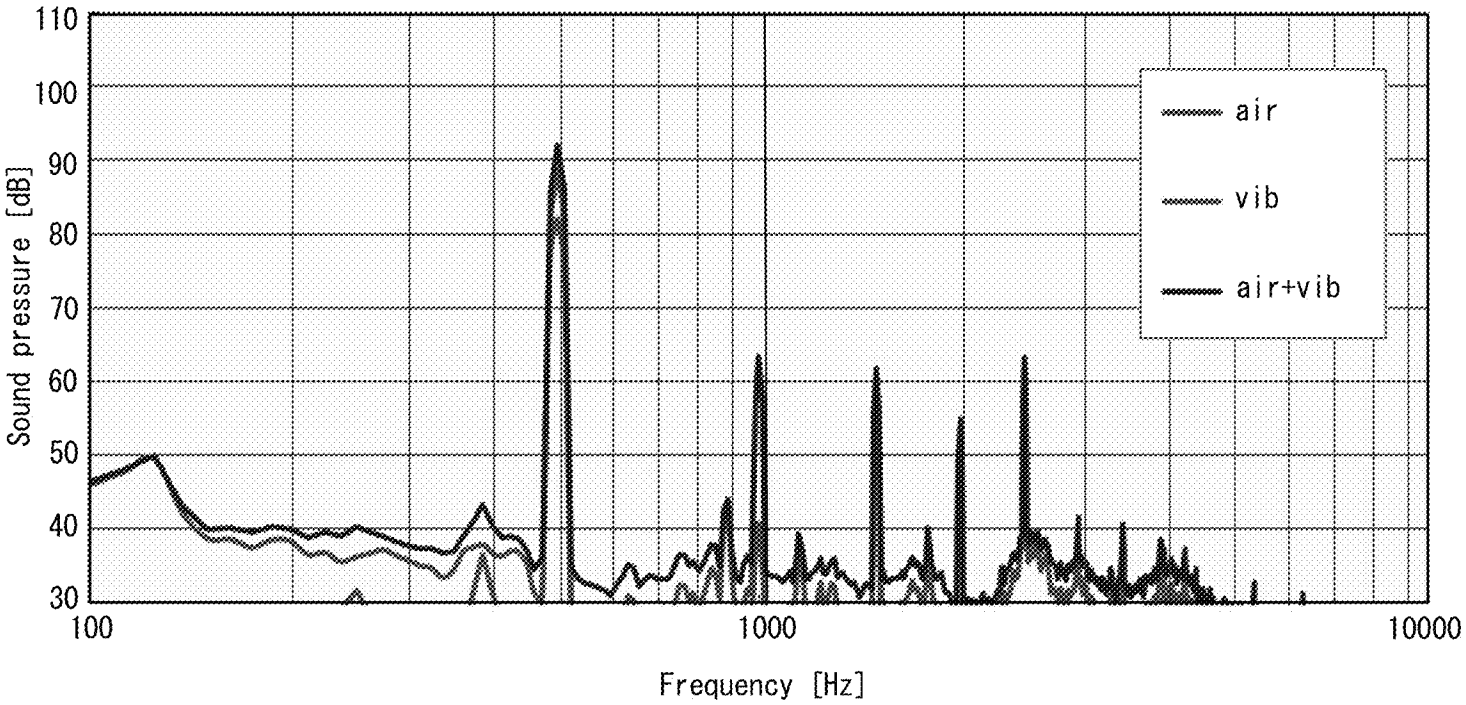
FIG. 21 illustrates the measurement results, using another comparative example (known technique), for air-conducted sound and human body vibration sound from an acoustic device.

As comparative examples, FIGS. 20 and 21 illustrate the results of measuring the power spectrum of air-conducted sound and/or human body vibration sound measured by the measurement system 10 when AFTERSHOKZ® and a bone conduction sound collector ear, which are both known bone conduction headphones, output a fundamental frequency of 500 Hz while placed in contact with the tragus. In both FIGS. 20 and 21, almost no harmonics at or above the sixth harmonic are generated under the above-described predetermined condition for counting. In greater detail, three or more harmonics that are at or above the sixth harmonic and that have a volume exceeding a volume 45 dB below the volume of the fundamental frequency are not measured. Furthermore, three or more harmonics at or above the sixth harmonic and exceeding a value that is half of the measured value of the fundamental frequency are not measured.

Figure 22:
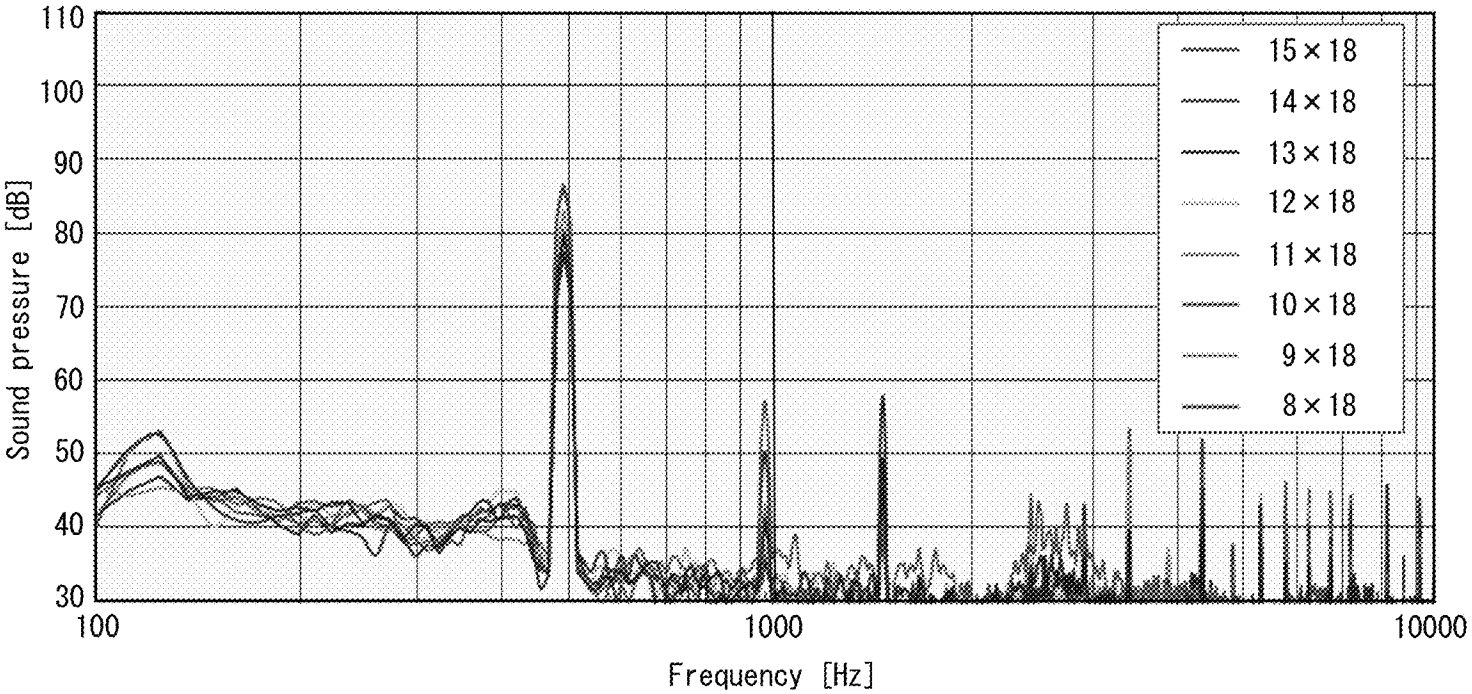
FIG. 22 is a graph of measurement results, using the measurement system according to Embodiment 1, for air-conducted sound and human body vibration sound in the case of changing the size of the panel in the acoustic device.

Next, FIGS. 22 and 23 illustrate the measurement results when the size of the principal surface of the panel 102*a* of the acoustic device 1 is changed from a width of 10 mm and a height of 18 mm ("10×18"). FIGS. 22 and 23 illustrate the measurement results for a plurality of patterns from a width of 15 mm and height of 18 mm ("15×18") to a width of 8 mm and a height of 18 mm ("8×18"). As illustrated in FIG. 22, it is clear that in each case, a plurality of harmonics at or above the sixth harmonic are generated under the above-described predetermined condition for counting. Furthermore, as illustrated in FIG. 23, three or more harmonics that are at or above the sixth harmonic and that have a volume exceeding a volume 45 dB below the volume of the fundamental frequency are measured for any size of the principal surface of the panel 102*a*. For example, when the width of the principal surface is 14 mm and the length is 18 mm ("14×18"), the volume of the fundamental frequency is 79.8 dB. The volume of the sixth, ninth, and twelfth harmonics, for example, is 38.9 dB, 44.6 dB, and 43.0 dB. Each of these values exceeds a volume 45 dB below the volume of the fundamental frequency, i.e. 34.8 dB, and hence three or more harmonics that are at or above the sixth harmonic and that have a volume exceeding a volume 45 dB below the volume of the fundamental frequency are measured. The volume of the seventh, ninth, and eleventh harmonics, for example, is 42.3 dB, 44.6 dB, and 42.0 dB. Accordingly, three or more harmonics at or above the sixth harmonic and exceeding a volume that is half of the volume of the fundamental frequency are measured.

The number of harmonics counted under the above-described predetermined condition for counting is more preferably four or more. The number of harmonics counted under the above-described predetermined condition for counting is even more preferably five or more. The frequency band in which the harmonics are generated is preferably within the audible band.

Three or more of the above-described harmonics at or above the sixth harmonic are preferably within a range of 3 kHz to 10 kHz with respect to a fundamental frequency of 300 Hz to 1 kHz. Four or more of the above-described harmonics at or above the sixth harmonic are more preferably within a range of 3 kHz to 10 kHz with respect to a fundamental frequency of 300 Hz to 1 kHz. Five or more of the above-described harmonics at or above the sixth harmonic are more preferably within a range of 3 kHz to 10 kHz with respect to a fundamental frequency of 300 Hz to 1 kHz.

In this way, according to the disclosed acoustic device 1, harmonics at or above the sixth harmonic are generated at a high volume (level). Therefore, the disclosed acoustic device 1 allows perception of a bright, clear sound.

While an example in which the acoustic reproduction device is a hearing aid 1 has been described in this embodiment, this example is not limiting. For example, the acoustic reproduction device may be a headphone or earphone, in which case the microphone 20*a* is not provided. In this case, the acoustic reproduction device may reproduce sound based on music data stored in an internal memory of the acoustic reproduction device or sound based on music data stored on an external server or the like and transmitted over a network.

In this embodiment, although measurement is made while contacting the vibrating body 10*a* of the acoustic device 1 to the tragus of the ear model 50 in the measurement system 10, the vibrating body 10*a* may be contacted to any part of the ear model 50 in the measurement system 10. For example, the vibrating body 10*a* may be contacted to the auricle of the ear model 50 in the measurement system 10.

While the fundamental frequency generated by the acoustic device 1 in this embodiment is 500 Hz, the fundamental frequency is not limited to being 500 Hz. The fundamental frequency may be a sound at any predetermined frequency within a range of 300 Hz or greater to 1000 Hz or less, such as 400 Hz, 800 Hz, or the like.

Embodiment 2

The following describes Embodiment 2. As compared to Embodiment 1, the structure of the acoustic device 1 differs in Embodiment 2. The remaining structure is the same as in Embodiment 1. An example of the acoustic device 1 being a hearing aid 1 is described, as in Embodiment 1. Where the structure is the same as in Embodiment 1, the same reference signs are applied, and a description thereof is omitted.

Figure 24:
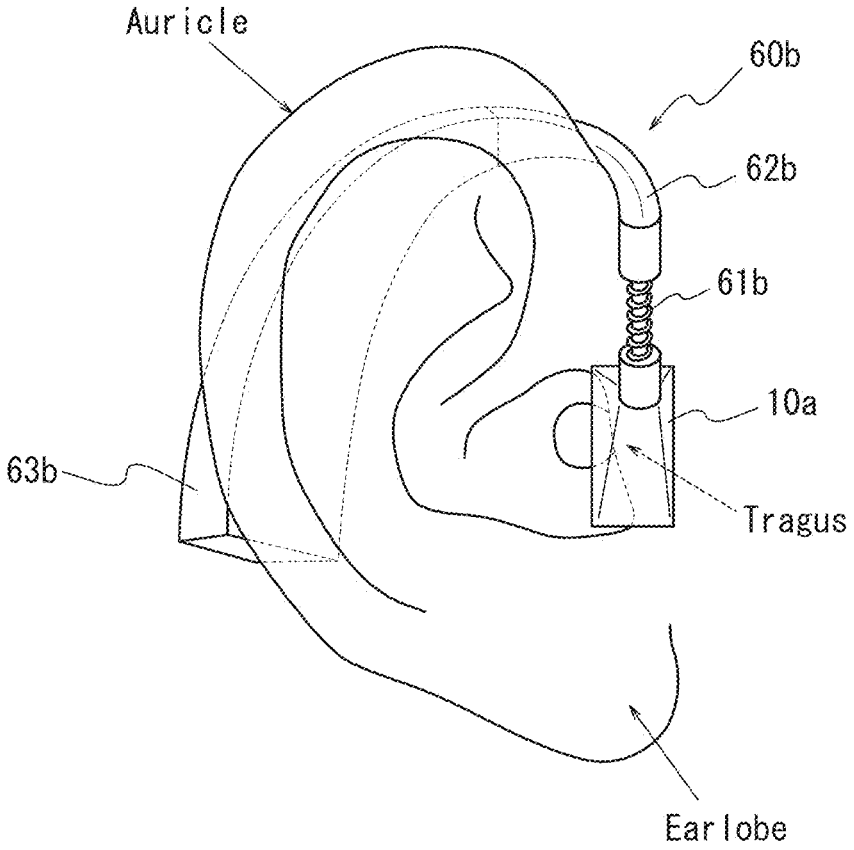
FIG. 24 schematically illustrates the structure of an acoustic device according to Embodiment 2.
Figure 25:
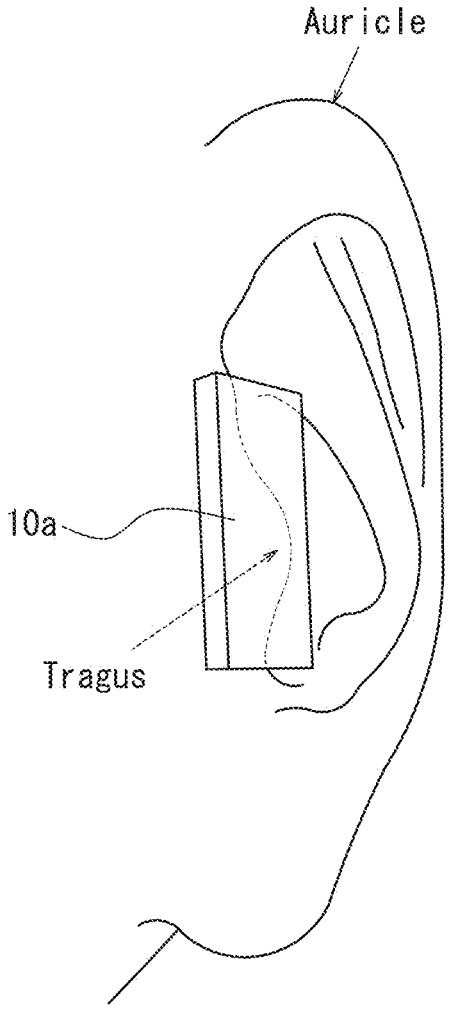
FIG. 25 illustrates the portion of the acoustic device according to Embodiment 2 that contacts the tragus.

FIG. 24 schematically illustrates the structure of the hearing aid 1 according to one of the disclosed embodiments. As illustrated in FIG. 24, the vibrating body 10*a* is contacted to the user's tragus from outside the user's ear. Therefore, a holder 60*b* is provided. From a different angle, FIG. 25 illustrates the vibrating body 10*a* in contact with the tragus. As illustrated in FIG. 25, the vibrating body 10*a* is contacted to the protruding tragus, and therefore by providing the below-described concavity 104*b* at the position of contact with the tragus, the area of contact between the vibrating body 10*a* and the tragus can be sufficiently ensured without crushing the tragus. In this embodiment, an example is described in which the position of contact with the user's ear is the tragus.

As illustrated in FIG. 24, the holder 60*b* includes a support 61*b*, an ear hook 62*b*, and a body 63*a*. The holder 60*b* holds the vibrating body 10*a* at the position at which the vibrating body 10*a* contacts the user's ear (at the tragus).

One end of the support 61*b* is connected to the vibrating body 10*a*. The support 61*b* has a hollow structure, and a lead wire is fed to the vibrating body 10*a* through this hollow structure. The support 61*b* is rigid enough so that the angle of the vibrating body 10*a* does not change. The other end of the support 61*b* is connected to one end of the ear hook 62*b*.

The ear hook 62*b* contacts the outside of the user's auricle to mount the hearing aid 1 on the user's ear. The ear hook 62*b* is preferably shaped as a hook conforming to the user's auricle so as to mount the hearing aid 1 stably on the user's ear. The other end of the ear hook 62*b* is connected to the body 63*a*. The body 63*a* stores the microphone 20*a*, controller 30*a*, volume and sound quality adjustment interface 40*a*, and memory 50*a* therein.

Figure 26:
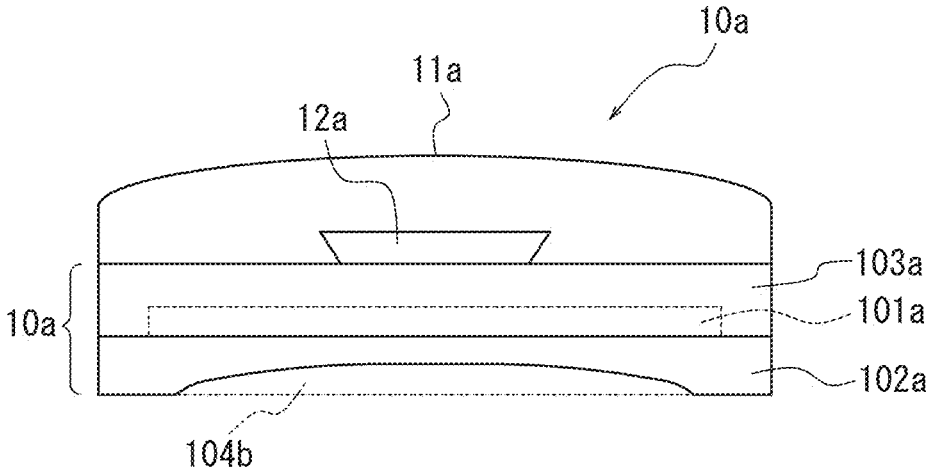
FIG. 26 is a side view of an acoustic device according to Embodiment 2 in the thickness direction of the vibration unit.

FIG. 26 is a side view of the vibrating body 10*a* as viewed in the thickness direction. As described above, the vibrating body 10*a* includes the piezoelectric element 101*a* and the panel 102*a*. The piezoelectric element 101*a* is preferably shaped as a plate, as in FIG. 26.

The piezoelectric element 101*a* is joined to the panel 102*a* by a joining member. The joining member is disposed between the principal surface of the piezoelectric element 101*a* and the principal surface of the panel 102*a*. The joining member is preferably a non-heat hardening adhesive material or double-sided tape. Apart from the surface joined to the panel 102*a*, the piezoelectric element 101*a* is covered by a mold 103*a*.

The principle surface of the panel 102*a* includes the concavity 104*b*. The concavity 104*b* is a recessed portion in the central region of the panel 102*a*. Since the tragus projects outward, it is necessary to secure the area of contact by crushing the tragus when contacting a flat surface thereto. Conversely, since the hearing aid 1 includes the concavity 104*b*, and this concavity 104*b* is contacted to the tragus, the area of contact can be secured without crushing the tragus. Since it is not necessary to crush the tragus, the holder 60*b* can have a simple structure. Furthermore, since the tragus is not crushed, a sense of comfort can be maintained when the user wears the hearing aid 1.

The panel 102*a* of the vibrating body 10*a* is pressed against the user's ear with a force of 0.1 N to 3 N. If the panel 102*a* is pressed with a force between 0.1 N and 3 N, vibration by the panel 102*a* is sufficiently transmitted to the ear. Furthermore, if the pressure is a small force of less than 3 N, the user suffers little fatigue even when wearing the hearing aid 1 for an extended period of time, thus maintaining a sense of comfort when wearing the hearing aid 1.

The concavity 104*b* of the panel 102*a* preferably includes a portion that contacts the user's ear (for example, the tragus) and a portion that does not contact the user's ear. By providing a portion that does not contact the user's ear within the panel 102*a*, generation of air-conducted sound may be allowed from this portion.

The principal surface of the panel 102*a* preferably has an area between 0.8 and 10 times the area of the principal surface of the piezoelectric element 101*a*. If the principal surface of the panel 102*a* has an area between 0.8 and 10 times the area of the principal surface of the piezoelectric element 101*a*, the panel 102*a* can deform in conjunction with expansion and contraction or bending of the piezoelectric element 101*a*, and the area of contact with the user's ear can be sufficiently guaranteed. The area of the panel is, for example, more preferably between 0.8 and 5 times the area of the piezoelectric element.

Figure 27:
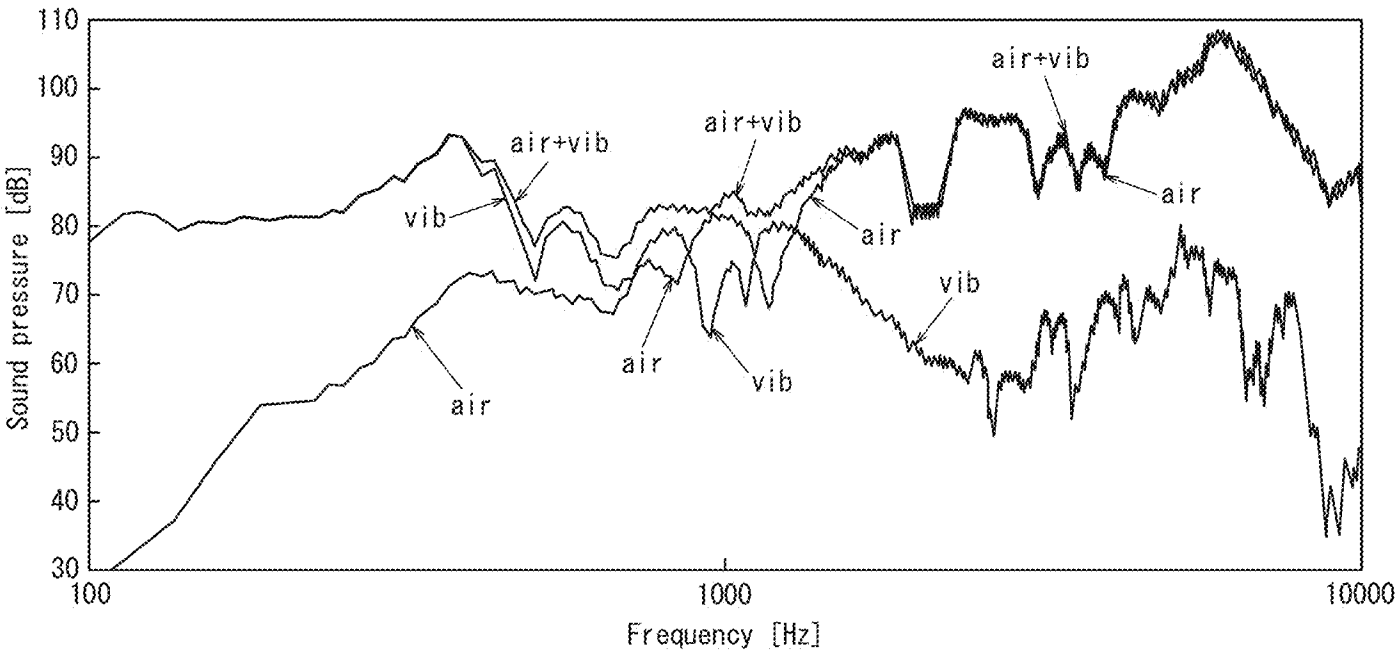
FIG. 27 illustrates measured values of the acoustic characteristics of the acoustic device according to Embodiment 2.

Transmission of sound from the hearing aid 1 according to Embodiment 2 is similar to the outline, as illustrated in FIG. 13, of the hearing aid 1 according to Embodiment 1. FIG. 27 illustrates measured values of the frequency characteristics of the hearing aid 1. In FIG. 27, "air" represents the frequency characteristics of sound by path II and path III in FIG. 13, and "vib" represents the frequency characteristics of sound by path IV in FIG. 13. Furthermore, "air+vib" represents the frequency characteristics of sound yielded by combining the sound of path II through path IV. As indicated by these measurement values, the sound pressure of low-frequency sound, namely sound pressure of low-frequency sound at 1 kHz or less in this embodiment, can be guaranteed by the human body vibration sound, thereby suppressing a loss in the sense of volume.

Figure 28A:
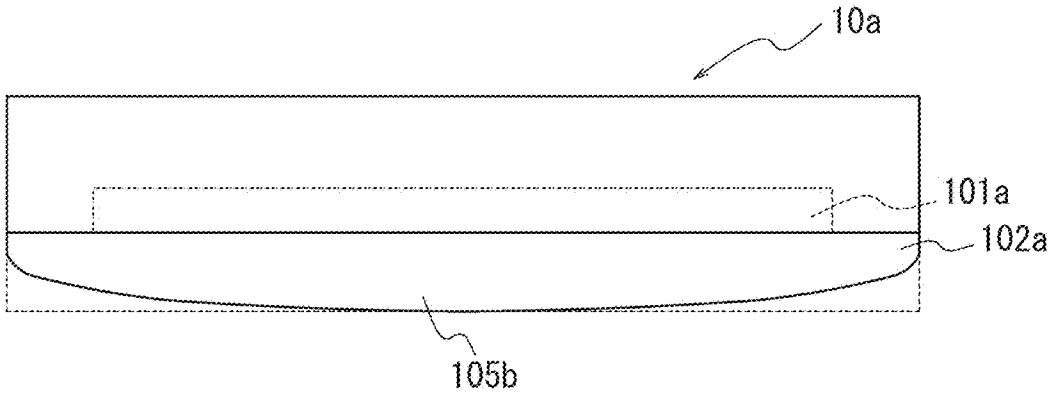
FIGS. 28A and 28B illustrate measured values in the case of providing a convexity instead of a concavity.
Figure 28B:
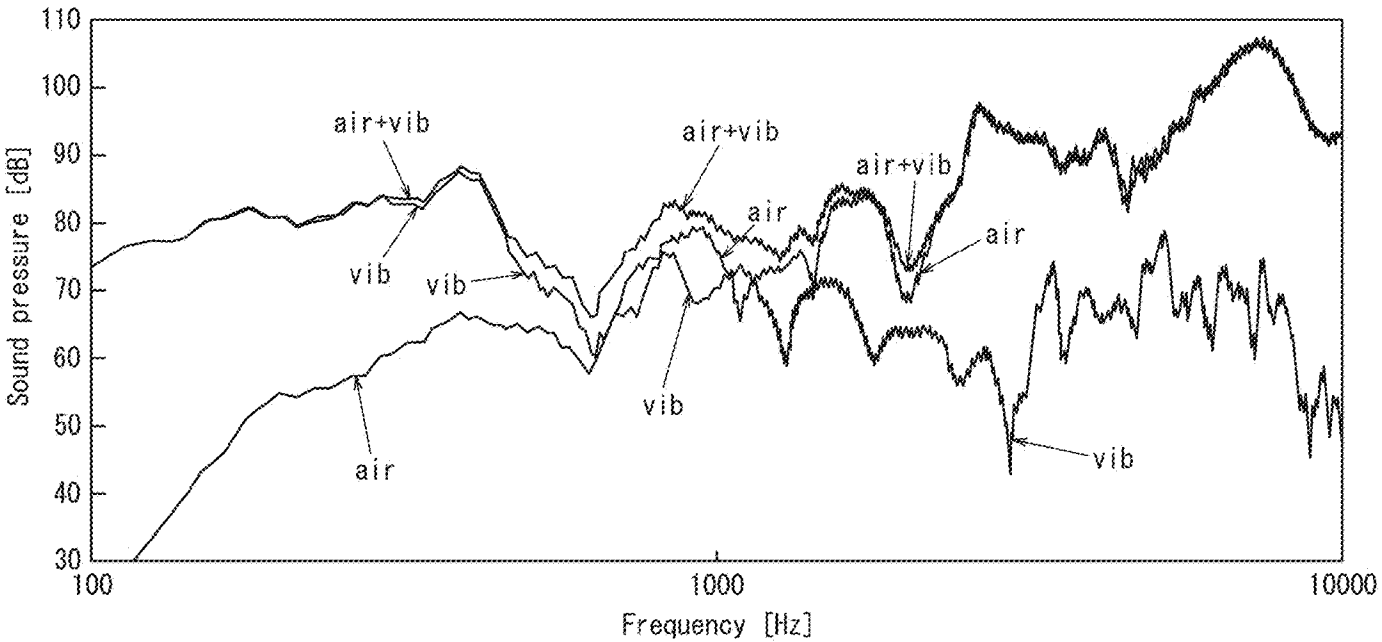
Figure 29:
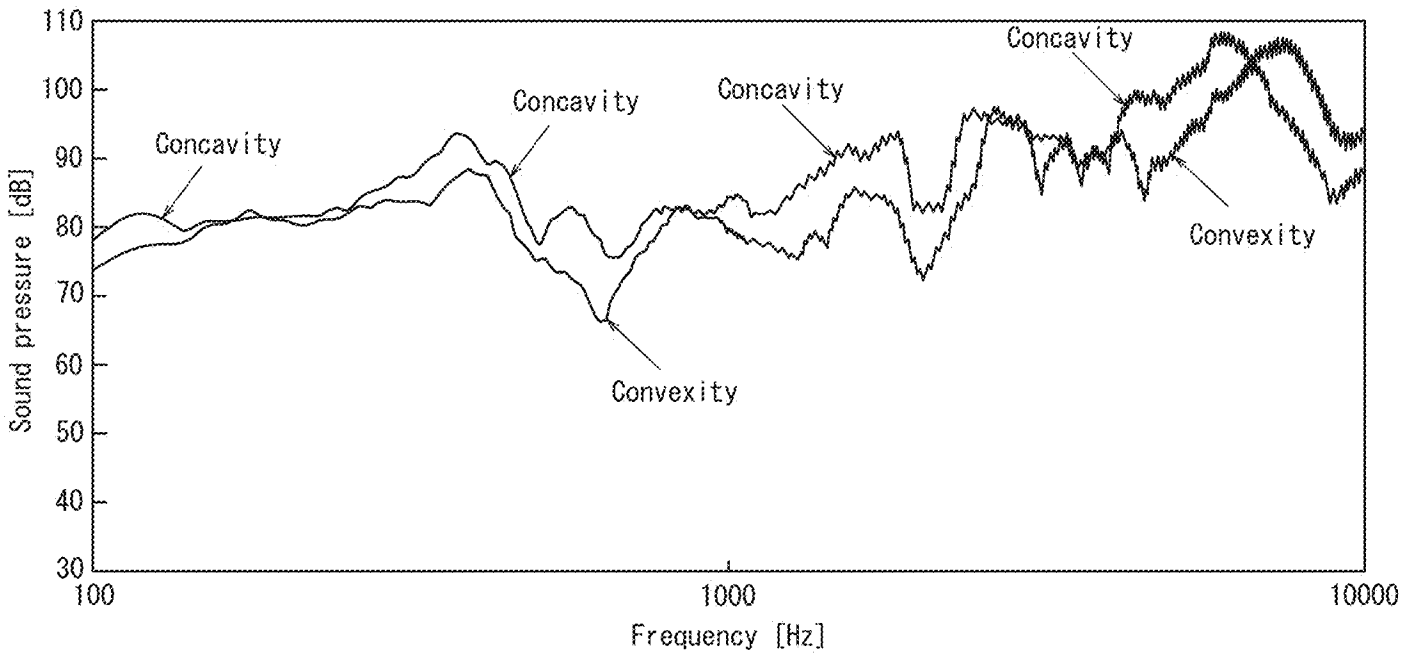
FIG. 29 illustrates a comparison of measured values in the cases of providing a concavity and a convexity.

FIG. 28B illustrates measured values in the case of providing a convexity 105*b* instead of the concavity 104*b* in the panel 102*a* (FIG. 28A). In FIG. 28B, "air" represents the frequency characteristics of sound by path II and path III in FIG. 13, and "vib" represents the frequency characteristics of sound by path IV in FIG. 13. Furthermore, "air+vib" represents the frequency characteristics of sound yielded by combining the sound of path II through path IV. FIG. 29 illustrates the frequency characteristics of "air+vib" for each of the cases of providing the concavity 104*b* and the convexity 105*b* in the panel 102*a*. As illustrated in FIG. 29, the structure in which the concavity 104*b* is provided in the panel 102*a* has a higher sound pressure in numerous frequency ranges, yielding excellent acoustic characteristics.

Also when measuring the acoustic device 1 (hearing aid 1) of Embodiment 2 with the measurement system 10, three or more harmonics that are at or above the sixth harmonic and that have a volume exceeding a volume 45 dB below the volume of the fundamental frequency are measured under the above-described count condition with regard to the air-conducted sound, as with the acoustic device of Embodiment 1. Three or more harmonics at or above the sixth harmonic and exceeding a volume that is half of the volume of the fundamental frequency are also measured. With regard to human body vibration sound as well, as with the acoustic device of Embodiment 1, three or more harmonics at or above a sixth harmonic and having a measured value exceeding a value 45 dB below the measured value of the fundamental frequency are not measured. Furthermore, three or more harmonics at or above the sixth harmonic and exceeding a value that is half of the measured value of the fundamental frequency are not measured. Accordingly, for the acoustic device 1 of Embodiment 2 as well, with regard to the sound that is a combination of the air-conducted sound and human body vibration sound, three or more harmonics that are at or above the sixth harmonic and that have a volume exceeding a volume 45 dB below the volume of the fundamental frequency are measured. Three or more harmonics at or above the sixth harmonic and exceeding a volume that is half of the volume of the fundamental frequency are also measured.

Embodiment 3

The following describes Embodiment 3. As compared to Embodiments 1 and 2, the structure of the measurement system 10 differs in Embodiment 3. The remaining structure is the same as in Embodiment 1 or 2. Where the structure is the same as in Embodiment 1 or 2, the same reference signs are applied, and a description thereof is omitted.

Figure 30:
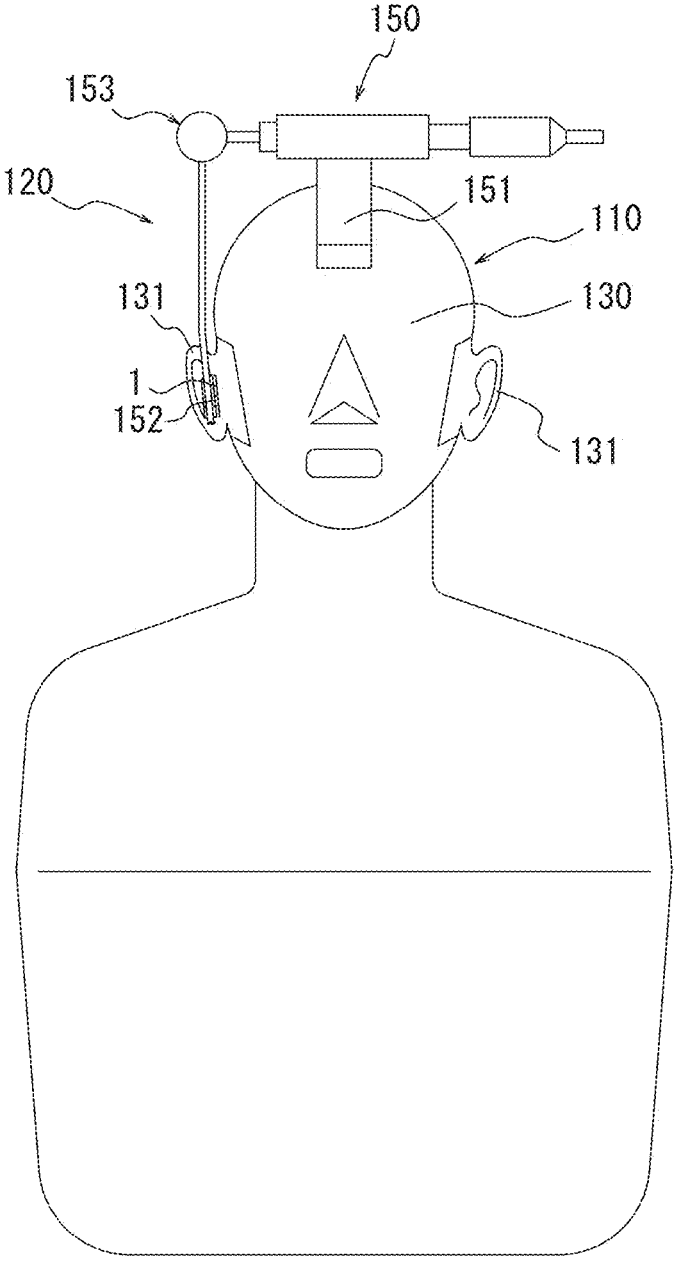
FIG. 30 schematically illustrates the structure of a measurement system according to Embodiment 3.

FIG. 30 schematically illustrates the structure of a measurement system according to Embodiment 3. In the measurement system 110 of this embodiment, the structure of an acoustic device mount 120 differs from that of the acoustic device mount 20 in Embodiment 1, whereas the remaining structure is similar to that of Embodiment 1. Accordingly, the measurement unit 200 in Embodiment 1 is omitted from FIG. 24. The acoustic device mount 120 is provided with a human head model 130 and a holder 150 that holds the acoustic device 1 targeted for measurement. The head model 130 is, for example, HATS, KEMAR, or the like. Artificial ears 131 of the head model 130 are detachable from the head model 130.

Figure 31A:
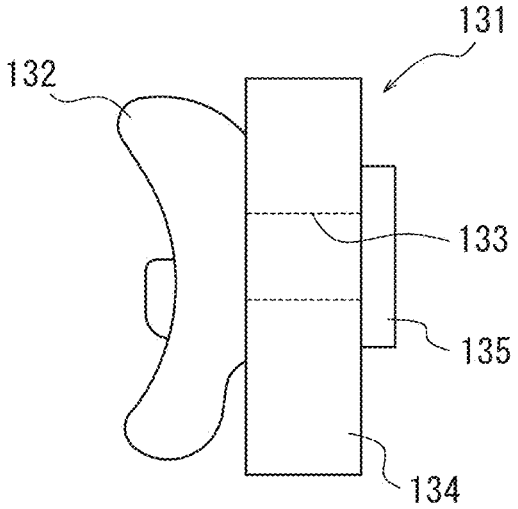
FIGS. 31A and 31B are detailed diagrams of the measurement system in FIG. 30.
Figure 31B:
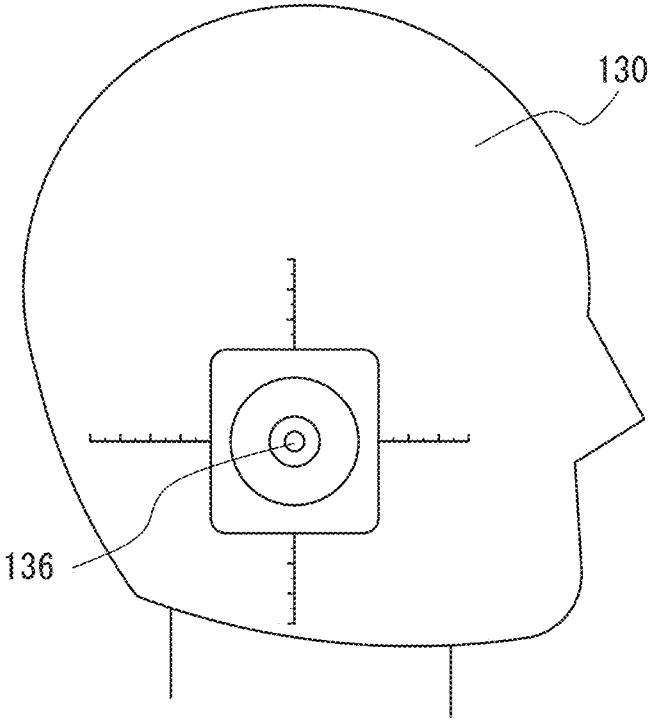

The artificial ear 131 forms an ear model and includes, like the ear model 50 in Embodiment 1, an artificial auricle 132 and an artificial external ear canal unit 134, joined to the artificial auricle 132, in which an artificial external ear canal 133 is formed, as illustrated by the side view in FIG. 31A of the artificial ear 131 removed from the head model 130. Like the ear model 50 in Embodiment 1, a vibration detector 135 provided with a vibration detection element is disposed at the periphery of the opening in the artificial external ear canal 133 in the artificial external ear canal unit 134. As illustrated by the side view in FIG. 31B with the artificial ear 131 removed, a sound pressure gauge 136 provided with a microphone is disposed in the center on the mount for the artificial ear 131 in the head model 130. The sound pressure gauge 136 is disposed so as to measure sound pressure of sound propagating through the artificial external ear canal 133 of the artificial ear 131 once the artificial ear 131 is mounted on the head model 130. Like the ear model 50 in Embodiment 1, the sound pressure gauge 136 may be disposed on the artificial ear 131 side. The vibration detection element with which the vibration detector 135 is configured and the microphone with which the sound pressure gauge 136 is configured are connected to the measurement unit in a similar way as in Embodiment 1.

A holder 150 is attached to the head model 130 detachably and includes a head fixing portion 151 for fixing to the head model 130, a support 152 that supports the acoustic device 1 targeted for measurement, and an articulated arm 153 connecting the head fixing portion 151 and the support 152. The holder 150 is configured so that, like the holder 70 in Embodiment 1, the pressing force and contact position, on the artificial ear 131, of the acoustic device 1 supported by the support 152 can be adjusted via the articulated arm 153.

The measurement system 110 of this embodiment yields measurement results similar to those of the measurement system 10 of Embodiment 1. Among other effects, in this embodiment, the acoustic device 1 is evaluated by detachably mounting the artificial ear 131 for vibration detection on the human head model 130, thus allowing evaluation that conforms more closely to the actual form of use by taking into consideration the effect of the head.

Although this disclosure is based on embodiments and drawings, it is to be noted that various changes and modifications will be apparent to those skilled in the art based on this disclosure. Therefore, such changes and modifications are to be understood as included within the scope of this disclosure. For example, the functions and the like included in the various units and members may be reordered in any logically consistent way. Furthermore, units and members may be combined into one or divided.

REFERENCE SIGNS LIST

1 Acoustic device (hearing aid)
10, 110 Measurement system
20 Acoustic device mount
30 Base
31 A/D converter
32 Signal processor
33 D/A converter
34 Piezoelectric amplifier
50 Ear model
51 Artificial auricle
52 Artificial external ear canal unit
53 Artificial external ear canal
54 Support member
55 Vibration gauge
56 Vibration detection element
60 Sound pressure gauge
61 Tube member
62 Microphone
70 Holder
71 Support
72 Arm
73 Movement adjuster
10*a* Vibrating body
11*a* Pressing member
12*a* Attaching portion
20*a* Microphone
30*a* Controller
40*a* Volume and sound quality adjustment interface
50*a* Memory
60*a*, 60*b* Holder
61*a*, 61*b* Support
62*a*, 62*b* Ear hook
63*a* Body
101*a* Piezoelectric element
102*a* Panel
103*a* Mold
104*b* Concavity
105*b* Convexity
111*a* Cutout portion
120 Acoustic device mount
130 Head model
131 Artificial ear
132 Artificial auricle
132 Artificial auricle
133 Artificial external ear canal
134 Artificial external ear canal unit
135 Vibration detector
136 Sound pressure gauge
150 Holder
151 Head fixing portion
152 Support
153 Articulated arm
200 Measurement unit
300 Sensitivity adjuster
301, 302 Variable gain amplifier circuit
400 Signal processor
410 A/D converter
411, 412 A/D conversion circuit
420 Frequency characteristic adjuster
421 Equalizer
430 Phase adjuster
431 Variable delay circuit
440 Output combiner
450 Frequency analyzer
460 Memory
470 Signal processing controller
500 PC
510 Connection cable
520 Display
521 Application screen
522-524 Icon
525 Measurement result display area
526 Icon to change measurement range

527 Measurement result display selection area
528 File icon
529 Measurement type icon
530 Help icon
600 Printer
601, 602 Arrow

The invention claimed is:

1. An acoustic device for transmitting sound to a user through vibration conduction by contacting a vibrating body to a human auricle, wherein when a measurement system, provided with an ear model including an artificial auricle and an artificial external ear canal and with a microphone that measures air-conducted sound in the artificial external ear canal, measures the air-conducted sound upon the acoustic device outputting a fundamental frequency at a predetermined frequency in an audible frequency band while placed in contact with the ear model, three or more harmonics at or above a sixth harmonic and having a volume exceeding a volume 45 dB below a volume of the fundamental frequency are measured under a first predetermined count condition.

2. The acoustic device of claim 1, wherein the vibrating body is pressed against the ear model with a force of 0.05 N to 3 N.

3. The acoustic device of claim 1, wherein the vibrating body is pressed against the ear model with a force of 0.1 N to 2 N.

4. The acoustic device of claim 1, wherein the vibrating body includes a piezoelectric element and a panel that flexes by being bent directly by the piezoelectric element.

5. The acoustic device of claim 1, wherein a contact surface of the vibrating body with respect to the ear model is from 0.1 $cm^2$ to 4 $cm^2$.

6. The acoustic device of claim 1, wherein a contact surface of the vibrating body with respect to the ear model is from 0.3 $cm^2$ to 3 $cm^2$.

7. The acoustic device of claim 1, wherein a vibration gauge that measures vibration in the ear model is further provided, and when measuring the vibration upon the acoustic device outputting the fundamental frequency while placed in contact with the ear model, three or more harmonics at or above a sixth harmonic and having a measured value exceeding a value 45 dB below a measured value of the fundamental frequency are not measured.

8. The acoustic device of claim 1, wherein the fundamental frequency is a predetermined frequency of 300 Hz or greater to 1000 Hz or less.

9. The acoustic device of claim 1, wherein the first predetermined condition is that harmonics having a signal-to-noise ratio (S/N) of 10 dB or more above a noise floor are counted.

10. The acoustic device of claim 1, wherein a frequency band in which the harmonics are measured is an audible band from 50 Hz to 20 kHz.

11. The acoustic device of claim 1, wherein a frequency band in which the harmonics are measured is an audible band from 3 kHz to 10 kHz.

12. A method of using an acoustic device, comprising placing the acoustic device of claim 1 against a user's auricle and hearing sound.

13. A method of using an acoustic device, comprising placing the acoustic device of claim 1 against a tragus of a user's auricle and hearing sound.

14. An acoustic device for transmitting sound to a user through vibration conduction by contacting a vibrating body to a human auricle, wherein when a measurement system, provided with an ear model including an artificial auricle and an artificial external ear canal and with a microphone that measures air-conducted sound in the artificial external ear canal, measures the air-conducted sound upon the acoustic device outputting a fundamental frequency at a predetermined frequency in an audible frequency band while placed in contact with the ear model, three or more harmonics at or above a sixth harmonic and exceeding a volume that is half of a volume of the fundamental frequency are measured under a second predetermined count condition.

15. The acoustic device of claim 14, wherein a vibration gauge that measures vibration in the ear model is further provided, and when measuring the vibration upon the acoustic device outputting the fundamental frequency while placed in contact with the ear model, three or more harmonics at or above a sixth harmonic and exceeding a value that is half of a measured value of the fundamental frequency are not measured under a predetermined count condition.

16. The acoustic device of claim 14, wherein the second predetermined condition is that the volume of the fundamental frequency is 70 dB or greater.

17. An acoustic device for transmitting sound to a user through vibration conduction by contacting a vibrating body to a human auricle, wherein when a measurement system, provided with an ear model including an artificial auricle and an artificial external ear canal, a microphone that measures air-conducted sound in the artificial external ear canal, and a vibration gauge that measures vibration in the ear model, measures volume that is combined based on a value measured by the microphone and a value measured by the vibration gauge upon the acoustic device outputting a fundamental frequency at a predetermined frequency in an audible frequency band while placed in contact with the ear model, three or more harmonics at or above a sixth harmonic and having a volume exceeding a volume 45 dB below a volume of the fundamental frequency are measured under a first predetermined count condition.

18. The acoustic device of claim 17, wherein when measuring the vibration upon the acoustic device outputting the fundamental frequency while placed in contact with the ear model, three or more harmonics at or above a sixth harmonic and having a measured value exceeding a value 45 dB below a measured value of the fundamental frequency are not measured under a predetermined count condition.

19. An acoustic device for transmitting sound to a user through vibration conduction by contacting a vibrating body to a human auricle, wherein when a measurement system, provided with an ear model including an artificial auricle and an artificial external ear canal, a microphone that measures air-conducted sound in the artificial external ear canal, and a vibration gauge that measures vibration in the ear model, measures volume that is combined based on a value measured by the microphone and a value measured by the vibration gauge while the acoustic device is placed in contact with the ear model, three or more harmonics at or above a sixth harmonic and exceeding a volume that is half of a volume of a fundamental frequency are measured under a third predetermined count condition.

20. The acoustic device of claim 19, wherein when measuring the vibration upon the acoustic device outputting the fundamental frequency while placed in contact with the ear model, three or more harmonics at or above a sixth harmonic and exceeding a value that is half of a measured value of the fundamental frequency are not measured under a predetermined count condition.

21. The acoustic device of claim 19, wherein the third predetermined condition is that the volume of the fundamental frequency is 75 dB or greater.

* * * * *